US011458647B2

(12) United States Patent
Mizutani

(10) Patent No.: US 11,458,647 B2
(45) Date of Patent: Oct. 4, 2022

(54) CUTTING DEVICE HAVING CUTTING BLADE RECIPROCALLY MOVABLE WITHIN MOVABLE RANGE AND PRINTING DEVICE PROVIDED WITH THE SAME

(71) Applicant: BROTHER KOGYO KABUSHIKI KAISHA, Nagoya (JP)

(72) Inventor: Hiromitsu Mizutani, Ichinomiya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 301 days.

(21) Appl. No.: 16/813,046

(22) Filed: Mar. 9, 2020

(65) Prior Publication Data

US 2020/0290230 A1 Sep. 17, 2020

(30) Foreign Application Priority Data

Mar. 13, 2019 (JP) ..... JP2019-046192

(51) Int. Cl.

| | |
|---|---|
| ***B41J 11/70*** | (2006.01) |
| ***B26D 5/08*** | (2006.01) |
| ***B41J 29/393*** | (2006.01) |
| ***B26D 5/00*** | (2006.01) |
| ***B26D 1/30*** | (2006.01) |
| ***B26D 5/06*** | (2006.01) |
| *B26D 7/00* | (2006.01) |

(52) U.S. Cl.

CPC ..... *B26D 5/005* (2013.01); *B26D 1/305* (2013.01); *B26D 5/06* (2013.01); *B26D 5/086* (2013.01); *B41J 11/703* (2013.01); *B41J 29/393* (2013.01); *B26D 2007/005* (2013.01)

(58) Field of Classification Search

CPC ..... B26D 5/005; B26D 1/305; B26D 5/06; B26D 5/086; B26D 2007/005; B41J 11/703; B41J 29/393

See application file for complete search history.

(56) References Cited

U.S. PATENT DOCUMENTS

2003/0126962 A1* 7/2003 Bland ..... B41J 15/005 83/13
2013/0209154 A1* 8/2013 Kasugai ..... B65H 35/06 400/611

FOREIGN PATENT DOCUMENTS

JP 2012-139778 A 7/2012
WO WO-0242084 A1 * 5/2002 ..... B41J 11/006

* cited by examiner

*Primary Examiner* — Yaovi M Ameh
(74) *Attorney, Agent, or Firm* — Kenealy Vaidya LLP

(57) ABSTRACT

In a cutting device, a cutting blade is reciprocally movable within a movable range including a first retracted position away from a target to be cut and a cut complete position at which cutting of the target is to be completed. A memory is configured to store cutting data indicating the first retracted position. A controller is configured to perform controlling, in response to determining that the cutting blade has stopped at an intervening position between a cut start position at which cutting of the target is started and the cut complete position, a drive portion to move the cutting blade from the intervening position to a second retracted position positioned within the movable range and away from the target. The controller is configured to further perform updating the cutting data stored in the memory so as to indicate the second retracted position in place of the first retracted position.

19 Claims, 15 Drawing Sheets

CUTTING DEVICE HAVING CUTTING BLADE RECIPROCALLY MOVABLE WITHIN MOVABLE RANGE AND PRINTING DEVICE PROVIDED WITH THE SAME

CROSS REFERENCE TO RELATED APPLICATION

This application claims priority from Japanese Patent Application No. 2019-046192 filed. Mar. 13, 2019. The entire content of the priority application is incorporated herein by reference.

TECHNICAL FIELD

The present disclosure relates to a cutting device and a printing device.

BACKGROUND

Printing devices using label tape as the printing medium and equipped with a cutting mechanism are well known in the art. The cutting mechanism is provided to cut the label tape after the tape has been printed. The cutting mechanism includes a drive motor, and a movable blade. The movable blade has a shaft hole and is supported so as to be pivotable about the shaft hole. Normally, the movable blade is in an idle state (home position) and is separated from the label tape when in the home position. When the drive motor is driven, the drive force of the motor advances the movable blade from the home position toward the label tape so that the movable blade cuts the label tape. After the tape is cut, the drive force of the drive motor retracts the movable blade, returning the movable blade to the home position. A microswitch is provided for detecting when the movable blade is in the home position.

SUMMARY

However, some issues have arisen with the conventional technology. First, if the movable blade comes to a stop at an abnormal position between the position at which the blade begins to cut the printing medium and the position at which the blade completes the cut through the printing medium, the movable blade does not operate normally thereafter. Second, the label tape is often housed in a cartridge (corresponding to the tape cassette) in a wound state. In such cases, the cartridge is detachably accommodated inside the printing device. However, the cartridge cannot be properly mounted in or removed from the printing device when the movable blade comes to a stop in an abnormal position.

In view of the foregoing, it is an object of the present disclosure to provide a cutting device and a printing device capable of performing a cutting operation, even when the movable blade is stopped in an abnormal position.

In order to attain the above and other objects, the present disclosure provides a cutting device including: a cutting blade; a drive portion; a memory; and a controller. The cutting blade is reciprocally movable within a movable range including a first retracted position away from a target to be cut and a cut complete position at which cutting of the target is to be completed. The drive portion is configured to move the cutting blade. The memory is configured to store cutting data indicating at least the first retracted position. The controller is configured to perform: (a) controlling; (b) controlling; (c) controlling; and (d) updating. The (a) controlling controls the drive portion to move the cutting blade from the first retracted position to the cut complete position according to the cutting data, thereby cutting the target. The (b) controlling controls the drive portion to move the cutting blade from the cut complete position after the (a) controlling is completed. The (c) controlling controls, in response to determining that the cutting blade has stopped at an intervening position during one of the (a) controlling and the (b) controlling, the drive portion to move the cutting blade from the intervening position to a second retracted position. The intervening position is in between a cut start position at which cutting of the target is started and the cut complete position. The second retracted position is positioned within the movable range and is away from the target. The (d) updating updates the cutting data stored in the memory so as to indicate the second retracted position in place of the first retracted position.

According to another aspect, present disclosure provides a printing device including a printing portion; and a cutting device. The printing portion is configured to perform a print on a target. The cutting device includes: a cutting blade; a drive portion; a memory; and a controller. The cutting blade is reciprocally movable within a movable range including a first retracted position away from a target to be cut and a cut complete position at which cutting of the target is to be completed. The drive portion is configured to move the cutting blade. The memory is configured to store cutting data indicating at least the first retracted position. The controller is configured to perform: (a) controlling; (b) controlling; (c) controlling; and (d) updating. The (a) controlling controls the drive portion to move the cutting blade from the first retracted position to the cut complete position according to the cutting data, thereby cutting the target. The (b) controlling controls the drive portion to move the cutting blade from the cut complete position after the (a) controlling is completed. The (c) controlling controls, in response to determining that the cutting blade has stopped at an intervening position during one of the (a) controlling and the (b) controlling, the drive portion to move the cutting blade from the intervening position to a second retracted position. The intervening position is in between a cut start position at which cutting of the target is started and the cut complete position. The second retracted position is positioned within the movable range and is away from the target. The (d) updating updates the cutting data stored in the memory so as to indicate the second retracted position in place of the first retracted position.

BRIEF DESCRIPTION OF THE DRAWINGS

The particular features and advantages of the disclosure as well as other objects will become apparent from the following description taken in connection with the accompanying drawings, in which.

DETAILED DESCRIPTION

Figure 1:
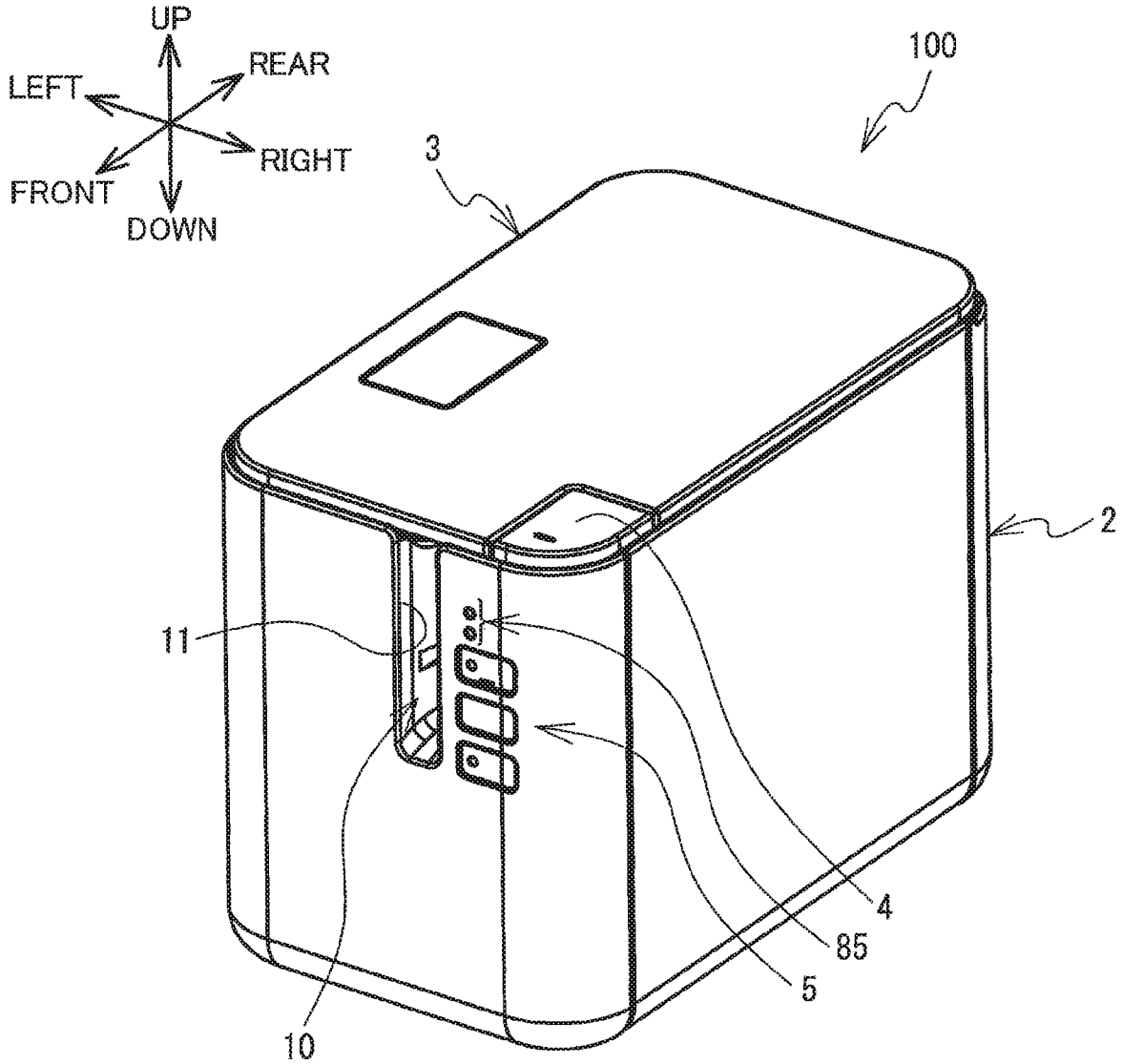
FIG. 1 is a front perspective view of a printing device according to an embodiment of the present disclosure when a cover is in a closed position as viewed from the upper-right side thereof.

Next, an embodiment of the present disclosure will be described while referring to the accompanying drawings. The referenced drawings are used to describe the technical features made possible with the present disclosure. The configurations of the devices illustrated in the drawings are merely examples, and the present disclosure is not intended to be limited to these configurations.

The mechanical structure of a printing device 100 will be described with reference to FIGS. 1 through 4. As illustrated in FIG. 3, the printing device 100 is provided with a cutting device 1. The cutting device 1 will be described later in greater detail. In the following description, the lower-right side, upper-left side, upper-right side, lower-left side, top side, and bottom side of the printing device 100 illustrated in FIG. 1 will be defined as the right side, left side, rear side, front side, top side, and bottom side of the printing device 100.

Figure 2:
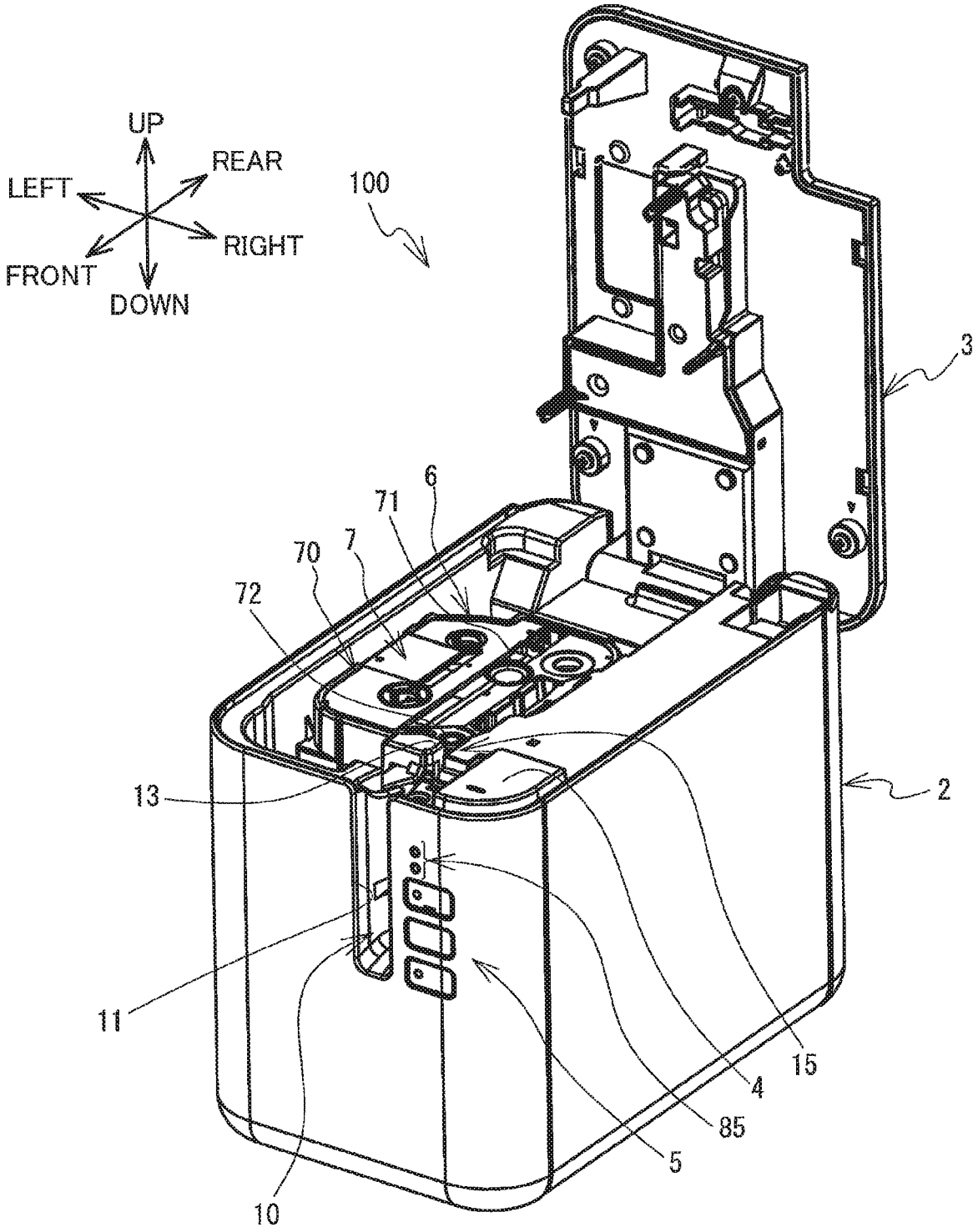
FIG. 2 is a front perspective view of the printing device according to the embodiment when the cover is in an open position and a tape cassette is mounted in the printing device as viewed from the upper-right side thereof.
Figure 3:
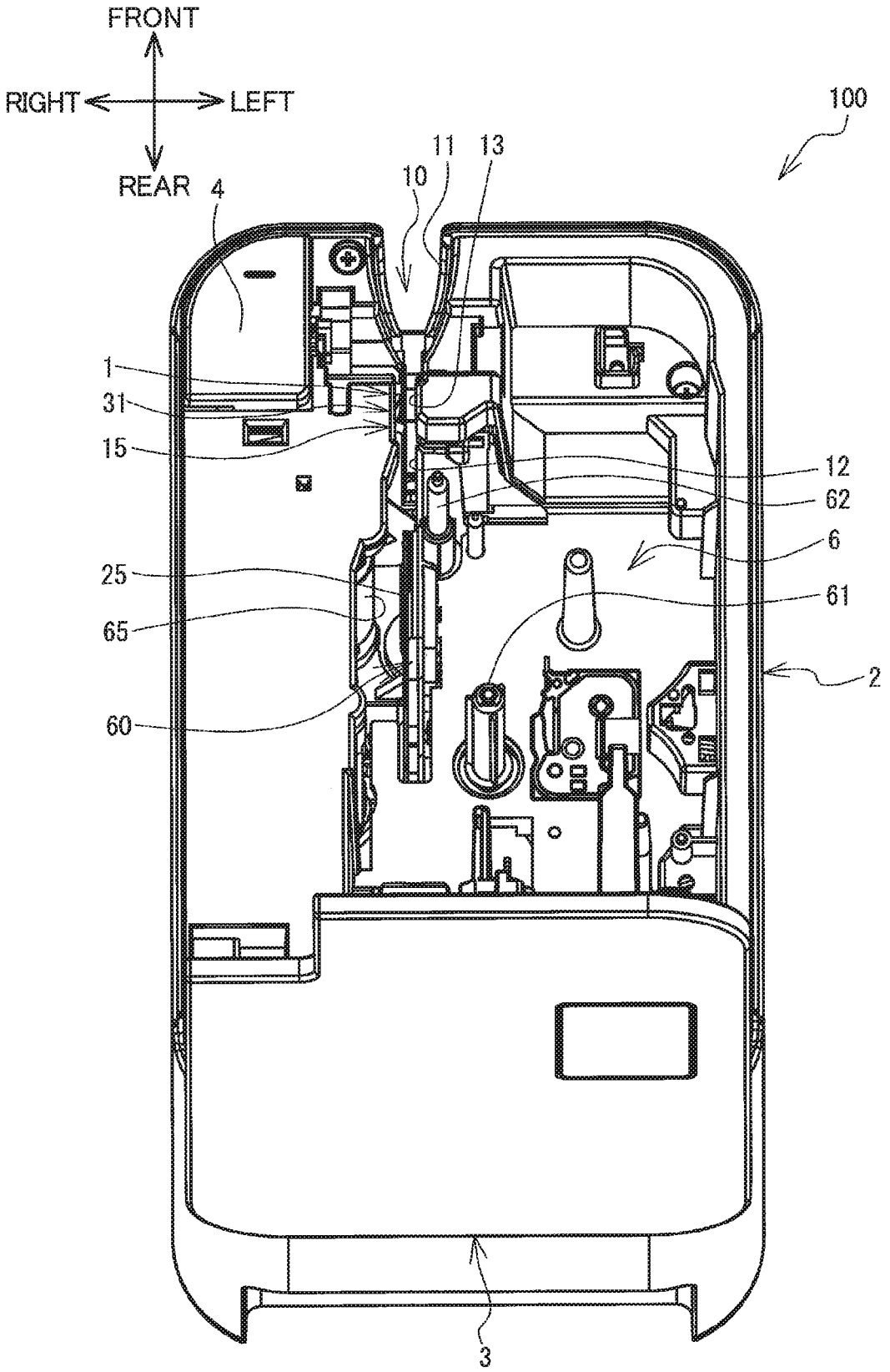
FIG. 3 is a perspective view of the printing device according to the embodiment when the cover is in the open position and the tape cassette is not mounted in the printing device as viewed from the upper-rear side thereof.

As illustrated in FIGS. 1 and 2, the printing device 100 is provided with a housing 2, and a cover 3. The housing 2 has a general rectangular parallelepiped shape. The cover 3 is rotatably supported at its rear edge on the top surface of the housing 2 and is capable of opening and closing on the top surface of the housing 2. In the following description, the position of the cover 3 when the cover 3 is closed relative to the housing 2 Will be called the "closed position" (see FIG. 1), and the position in which the cover 3 is open relative to the housing 2 will be called the "open position" (see FIG. 2). The cover 3 is constantly urged by an urging member (not illustrated) to rotate from the closed position toward the open position.

A locking part 4 is provided on the top surface of the housing 2 in the front-right corner thereof The locking part 4 engages with the cover 3 when the cover 3 is in the closed position. When pressed, the locking part 4 disengages from the cover 3, whereby the urging force of the urging member moves the cover 3 to the open position. Operating buttons 5 are provided on the front surface of the housing 2 near the upper-right corner thereof. The operating buttons 5 input various information into the printing device 100. A discharge opening 11 is formed in the front surface of the housing 2 on the left side of the operating buttons 5. The discharge opening 11 is elongated vertically and provides communication between the interior and exterior of the housing 2. LEDs 85 for reporting the status of the printing device 100 are provided on the front surface of the housing 2 above the operating buttons 5. The LEDs 85 will be described later in greater detail, As illustrated in FIGS. 2 and 3, a cartridge holder 6 is provided in the top surface of the housing 2. The cartridge holder 6 is recessed downward from the top surface of the housing 2. A tape cassette 7 can be mounted in and removed from the cartridge holder 6 vertically. The tape cassette 7 includes a cassette case 70. The cassette case 70 is a box-shaped member that is substantially rectangular in a plan view, The cassette case 70 accommodates an ink ribbon (not illustrated), and a tape 9 (see FIG. 4).

Figure 4:
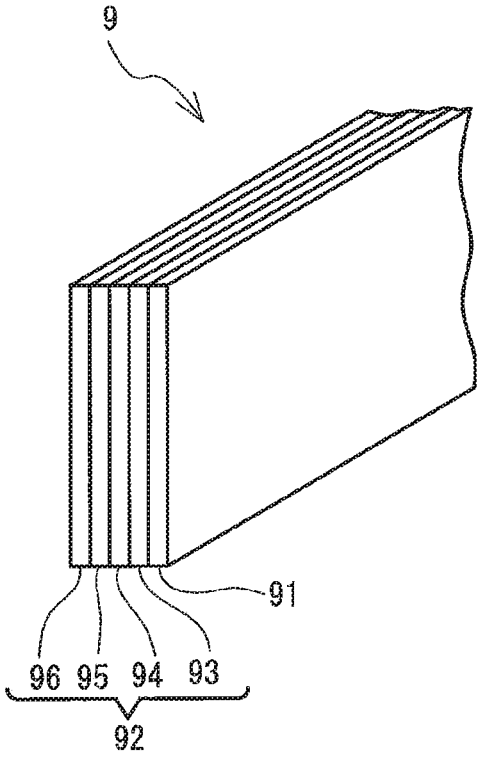
FIG. 4 is a perspective view of a tape used in the tape cassette and the printing device according to the embodiment.

As illustrated in FIG. 4, the tape 9 according to the present embodiment is composed of a plurality of layers. Specifically, the tape 9 has a printing base material 91, and an adhesive tape 92. The printing base material 91 is a clear film tape formed in a long strip. One surface of the printing base material 91 constitutes the printing surface on which the printing device 100 prints. The adhesive tape 92 is affixed to the printing surface side of the printing base material 91. The adhesive tape 92 has an adhesive layer 93, a background base material 94, an adhesive layer 95, and a release paper 96. The adhesive layer 93 is disposed between the background base material 94 and printing base material 91. The adhesive layer 95 is provided between the background base material 94 and release paper 96. The adhesive layers 93 and 95 are more accurately layers that are formed by coating both surfaces of the background base material 94 with adhesive.

As illustrated in FIG. 2, a ribbon take-up spool 71, and a tape drive roller 72 are provided in the cassette case 70. The ribbon take-up spool 71 and tape drive roller 72 are cylindrical members that extend vertically. The ribbon take-up spool 71 takes up ink ribbon that has been used in printing. The tape drive roller 72 conveys the tape 9.

As illustrated in FIG. 3, a thermal head 25, a ribbon take-up shaft 61, and a tape drive shaft 62 are provided in the cartridge holder 6. The thermal head 25 executes printing on the tape 9. The thermal head 25 is disposed on the right side of a head holder 60. The head holder 60 is disposed in the right section of the cartridge holder 6. The head holder 60 has a plate shape in a side view. The ribbon take-up shaft 61 is rotatably disposed in the left section of the head holder 60. The ribbon take-up shaft 61 extends vertically. The tape drive shaft 62 is rotatably disposed in the front section of the head holder 60. The tape drive shaft 62 extends vertically. The ribbon take-up shaft 61 and tape drive shaft 62 are coupled to a tape drive motor 26 (see FIG. 9).

A platen roller 65 and a sub-roller 66 (see FIG. 6) are rotatably disposed in the right section of the cartridge holder 6. The sub-roller 66 is provided on the front side of the platen roller 65. The platen roller 65 and sub-roller 66 can be moved in substantially the left-right direction between a position in which the platen roller 65 and sub-roller 66 are in proximity to the respective thermal head 25 and tape drive shaft 62 and a position in which the platen roller 65 and sub-roller 66 are separated from the respective thermal head 25 and tape drive shaft 62.

Figure 7A:
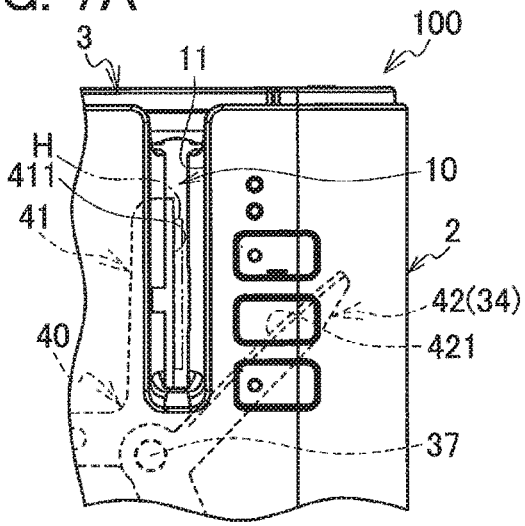
FIG. 7A illustrates a partial view of the front side of the printing device according to the embodiment when a first movable blade is in a maximum separation position.
Figure 7D:
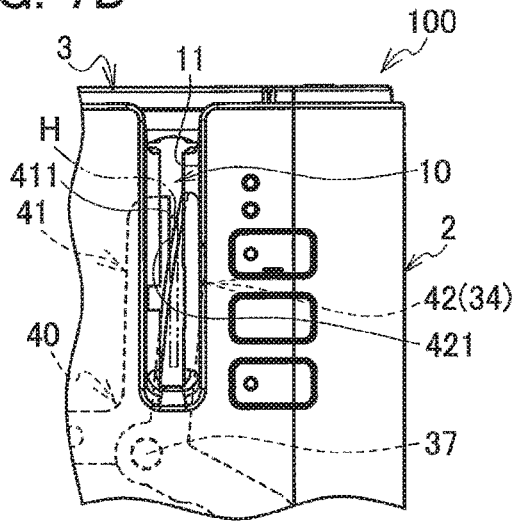
FIG. 7D illustrates a partial view of the front side of the printing device according to the embodiment when the first movable blade is in an abnormal position.

A recessed area 15 is formed forward of the cartridge holder 6 near the right-front corner of the same. The recessed area 15 is recessed downward from the top surface of the housing 2 and extends forward from the right-front corner of the cartridge holder 6 to the front surface of the housing 2. The recessed area 15 defines an open area 10. The open area 10 includes part of a conveying region. H through which the tape 9 is conveyed (see FIG. 7A). The conveying region H is the area through which the tape 9 passes when conveyed inside the housing 2. The rear side of the open area 10 is the upstream side in the conveying direction of the tape 9, while the front side of the open area 10 is the downstream side in the conveying direction. A blade unit 31 extends vertically through the approximate front-rear center of the open area 10. The blade unit 31 will be described later in greater detail.

The open area 10 includes the discharge opening 11, an entry opening 12, and a tape-insertion opening 13. The discharge opening 11 is an opening formed downstream of the blade unit 31 in the conveying direction. The portion of the tape 9 printed inside the housing 2 is discharged from the housing 2 through the discharge opening 11. The entry opening 12 is an opening on the upstream side of the blade unit 31 in the conveying direction. The entry opening 12 provides communication between the open area 10 and the cartridge holder 6. The portion of the tape 9 discharged from the tape cassette 7 enters the open area 10 through the entry opening 12. The tape-insertion opening 13 is an opening formed above the blade unit 31. When mounting the tape cassette 7 into the cartridge holder 6 from above, the tape 9 can enter the open area 10 through the tape-insertion opening 13. The discharge opening 11 and tape-insertion opening 13 are in communication with each other. The entry opening 12 and tape-insertion opening 13 are in communication with each other.

Next, the cutting device 1 will be described with reference to FIGS. 5 and 6. The cutting device 1 is positioned on the front side of the entry opening 12 and the rear side of the discharge opening 11 (see FIG. 3). The cutting device 1 includes the blade unit 31, a first movable blade drive motor 27A (see FIG. 9), and a second movable blade drive motor 27B. The blade unit 31 is disposed inside the housing 2. The blade unit 31 can cut through at least a portion of the tape 9. The blade unit 31 includes a first cutting blade 40 (see FIG. 6), and a second cutting blade 50 (see FIG. 5).

Figure 6:
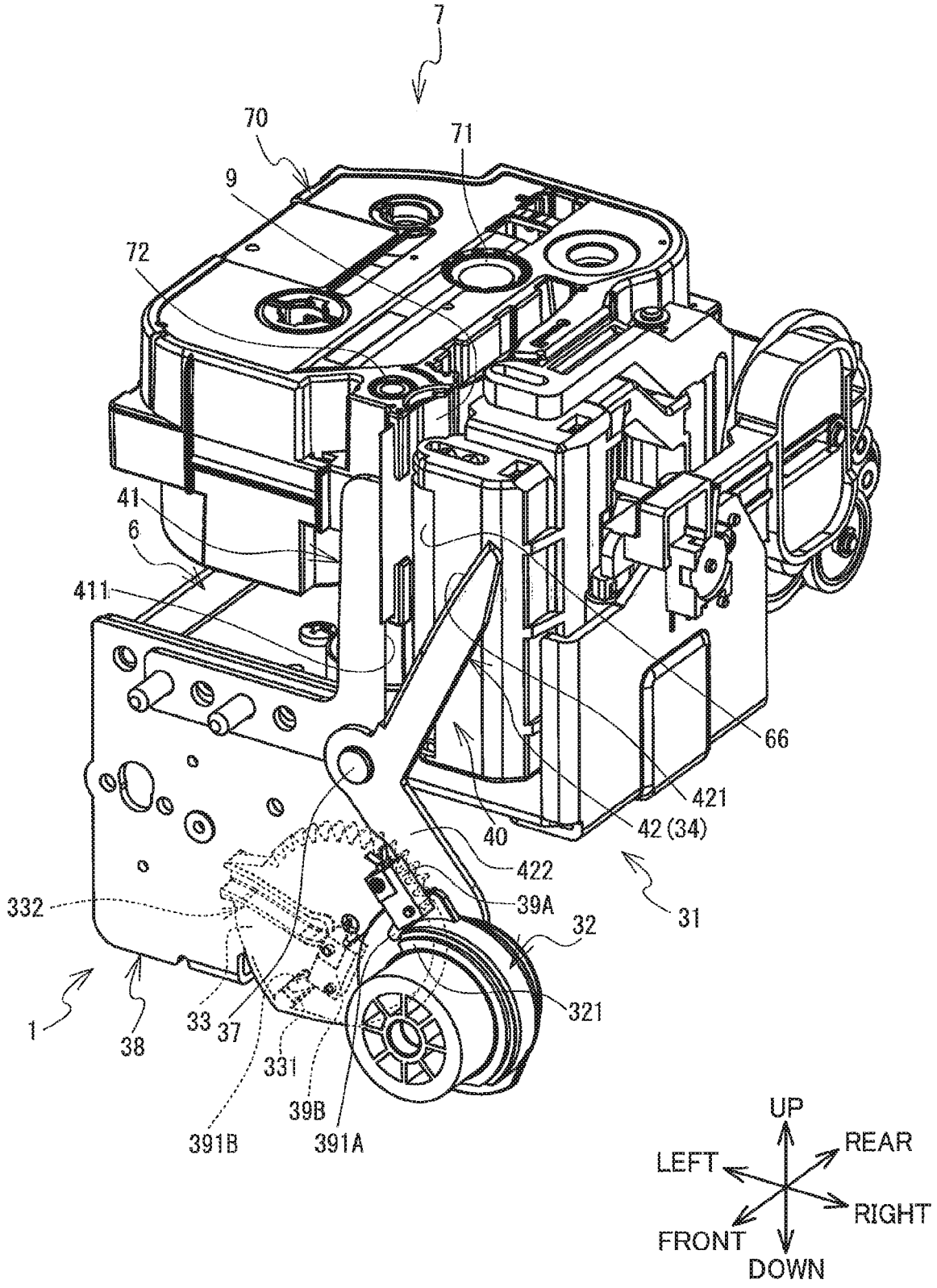
FIG. 6 is a front perspective view of the tape cassette and the cuffing device according to the embodiment as viewed from the upper-right side thereof, in which the second cutting blade is omitted.

As illustrated in FIG. 6, the first cutting blade 40 is provided with a fixed blade 41, and a first movable blade 42. The first cutting blade 40 can perform a full cut through the tape 9. A full cut is an operation for cutting off the printed portion of the tape 9 by cutting through all layers of the tape 9 (the printing base material 91 and adhesive tape 92 in the present embodiment).

The fixed blade 41 is disposed on the left side of the conveying region H (see FIGS. 7A through 7E). The fixed blade 41 is a plate member having a general L-shape in a rear-side view. The bottom end of the fixed blade 41 extends to the bottom wall of the recessed area 15. The top end of the fixed blade 41 extends near but beneath. the top edge of the side wall defining the recessed area 15 (see FIGS. 7A through 7E). A blade edge 411 extending vertically is formed along the right edge of the fixed blade 41. The fixed blade 41 is fixed to an anchoring plate 38. The anchoring plate 38 is fixed to the housing 2 and extends orthogonally to the front-rear direction. A rotating shaft 37 is provided in the bottom edge of the fixed blade 41. The rotating shaft 37 extends in the front-rear direction at a position below the bottom wall of the recessed area 15.

The first movable blade 42 is a plate member having a general V-shape that opens toward the right in a front-side view. The first movable blade 42 opposes the fixed blade 41 from the right side. The first movable blade 42 is rotatably supported by the rotating shaft 37 and is capable of rotating counterclockwise or clockwise in a front-side view. A blade edge 421 is formed along the left edge of the first movable blade 42 in the portion above the rotating shaft 37. The blade edge 421 extends substantially vertically. When the first movable blade 42 rotates counterclockwise in a front-side view about the rotating shaft 37, the upper portion of the first movable blade 42 approaches the upper portion of the fixed blade 41. When the first movable blade 42 rotates clockwise in a front-side view about the rotating shaft 37, the upper portion of the first movable blade 42 separates from the upper portion of the fixed blade 41.

The first movable blade drive motor 27A (see FIG. 9) can generate a rotational drive in both forward and reverse directions. The first movable blade drive motor 27A is coupled to the first movable blade 42 through a gear train (not illustrated) configured of a plurality of gears, and a first movable blade drive gear 32. The first movable blade drive gear 32 is rotatabiy supported on a support plate (not illustrated) mounted on the front side of the anchoring plate 38. The rotational drive of the first movable blade drive motor 27A is transmitted to the first movable blade drive gear 32 via the gear train, causing the first movable blade drive gear 32 to rotate. A pin (not illustrated) is provided on the rear surface of the first movable blade drive gear 32 at an eccentric position from the rotational center. The pin extends rearward from the rear surface of the first movable blade drive gear 32. The first movable blade 42 includes an arm portion 422 extending diagonally downward from a position beneath the rotating shaft 37. An elongate hole (not illustrated) is formed in the arm portion 422. The pin on the first movable blade drive gear 32 is engaged in the elongate hole fhrmed in the arm portion 422. When the first movable blade drive gear 32 rotates, the elongate hole engaged with the pin moves left and right as the position of the pin moves relative to the rotational center, causing the first movable blade 42 to oscillate back and forth. In other words, when the output shaft of the first movable blade drive motor 27A rotates in the forward direction, the first movable blade 42 is rotated (oscillated) about the rotating shaft 37 through the gear train and the first movable blade drive gear 32. More specifically, when the first movable blade drive gear 32 rotates in the forward direction, the first movable blade 42 oscillates once back and forth. The first movable blade drive gear 32 has a general cylindrical shape with an axial direction aligned in the front-rear direction. The first movable blade drive gear 32 is provided with a cam 321 that protrudes like a flange in a prescribed circumferential range around the outer cylindrical wall of the first movable blade drive gear 32.

A first movable blade sensor 39A is provided above the first movable blade drive gear 32. The first movable blade sensor 39A is fixed to the support plate with screws (not illustrated). The first movable blade sensor 39A is a limit switch that has a movable piece 391A, and a fixed piece (not illustrated). When the movable piece 391A is moved so as to contact the fixed piece, the first movable blade sensor 39A outputs an ON signal. When the movable piece 391A separates from the fixed piece, the first movable blade sensor 39A outputs an OFF signal.

In a retracted position of the first movable blade 42, the blade edge 421 of the first movable blade 42 is separated from the conveying region H of the tape 9. The blade edge 421 begins moving toward the fixed blade 41 from the retracted position and halts in a cut complete position after the blade edge 421 completes a full cut of the tape 9 present in the conveying region H. Subsequently, the first movable blade 42 returns to the retracted position from the cut complete position and remains halted in the retracted position. In the present embodiment, this series of operations performed by the first movable blade 42 will be called a cut operation.

When the first movable blade 42 is in the retracted position, the cam 321 presses against the movable piece 391A of the first movable blade sensor 39A (see FIG. 6), and the movable piece 391A contacts the fixed piece. Therefore, the first movable blade sensor 39A outputs an ON signal. When the first movable blade drive motor 27A is driven to rotate in the forward direction in this state, the gear train and the first movable blade drive gear 32 rotate and the movable piece 391A of the first movable blade sensor 39A separates from the cam 321. Consequently, the first movable blade sensor 39A outputs an OFF signal. Through the rotation of the first movable blade drive gear 32, the first movable blade 42 is moved from the retracted position to the cut complete position, and subsequently returns from the cut complete position to the retracted position. When the first movable blade 42 returns to the retracted position, the movable piece 391A of the first movable blade sensor 39A is pressed by the cam 321, and the first movable blade sensor 39A outputs an ON signal in place of the OFF signal. Hence, the first movable blade sensor 39A can detect when the first movable blade 42 has returned to the retracted position.

Figure 5:
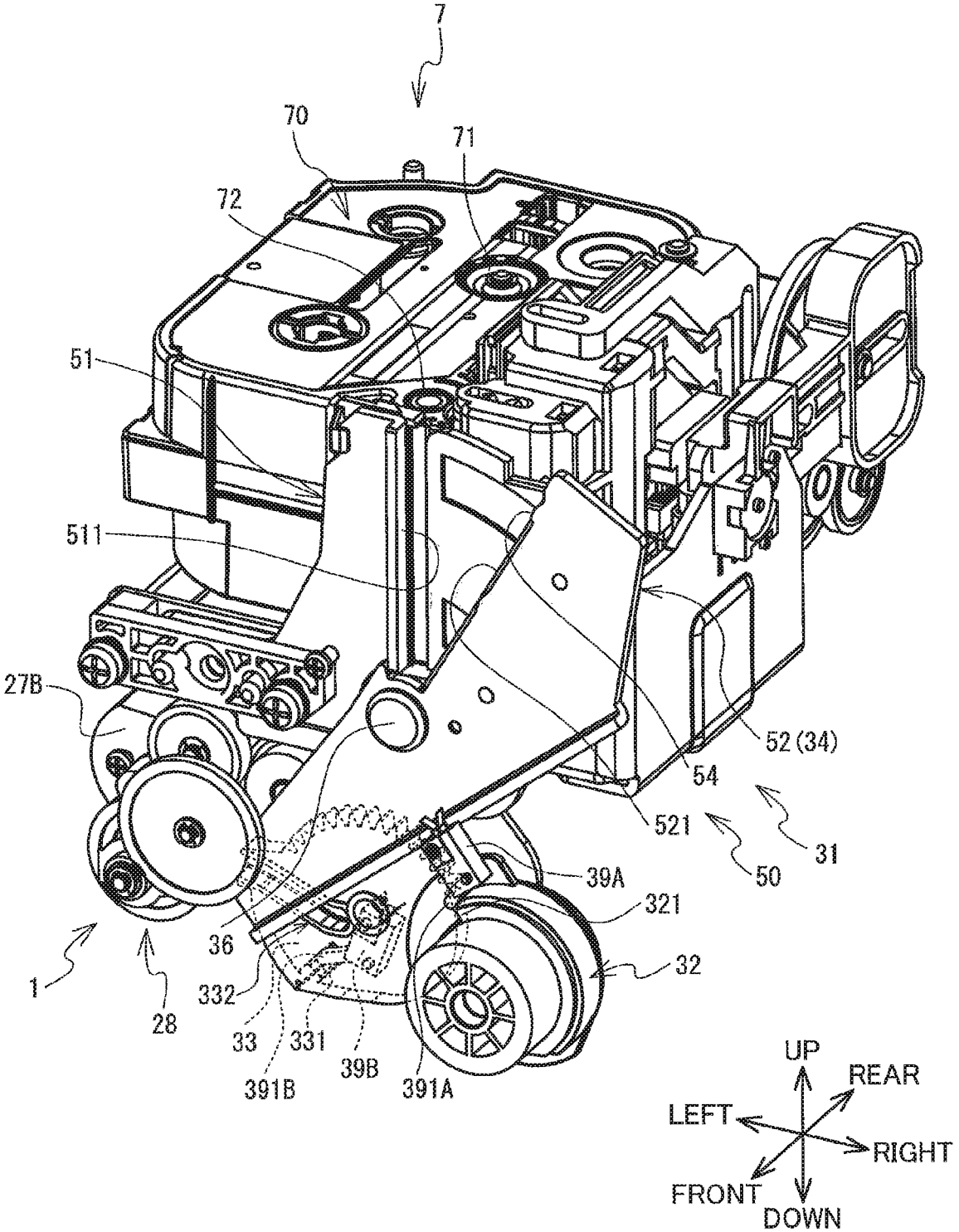
FIG. 5 is a front perspective view of the tape cassette and a cutting device according to the embodiment of the present disclosure as viewed from the upper-right side thereof, in which the cutting device is provided with a first cutting blade and a second cutting blade.

As illustrated in FIG. 5, the second cutting blade 50 is provided with a receiving part 51, and a second movable blade 52. The second cutting blade 50 can execute a partial cut of the tape 9. A partial cut (also referred to as a "half cut") is an operation for cutting only through some of the layers of the printed tape 9 (the printing base material 91, adhesive layer 93, background base material 94, and adhesive layer 95 in the present embodiment) and not other layers (the release paper 96 in the present embodiment).

The receiving part 51 is disposed on the left side of the conveying region H (see FIGS. 8.A through 8E). The receiving part 51 is a plate member having a general L-shape in a rear-side view. The bottom end of the receiving part 51 extends to the bottom wall of the recessed area 15. The top end of the receiving part 51 extends near but beneath the top edge of the side wall defining the recessed area 15 (see FIGS. 8A through 8E). A placement surface 511 is provided along the right edge of the receiving part 51. The printed tape 9 is placed over the placement surface 511. The receiving part 51 is fixed on the front side of the fixed blade 41 (see FIG. 6).

The second movable blade 52 is a plate member that extends in directions orthogonal to the front-rear direction. The second movable blade 52 is disposed on the front side of the first movable blade 42 (see FIG. 6) and opposes the receiving part 51 from the right side. The second movable blade 52 is rotatably supported by a rotating shaft 36 and is capable of rotating counterclockwise or clockwise in a front-side view. A blade edge 521 is formed along the left edge of the second movable blade 52 in the portion above the rotating shaft 36. The blade edge 521 extends substantially vertically. A protruding part 54 is provided on the second movable blade 52 above the blade edge 521. The protruding part 54 protrudes slightly toward the receiving part 51 from the second movable blade 52. When the second movable blade 52 rotates counterclockwise in a front-side view about the rotating shaft 36, the upper portion of the second movable blade 52 approaches the upper portion of the receiving part 51. When the second movable blade 52 rotates clockwise in a front-side view about the rotating shaft 36, the upper portion of the second movable blade 52 separates from the upper portion of the receiving part 51.

The second movable blade drive motor 27B can generate a rotational drive in both forward and reverse directions. The second movable blade drive motor 27B is coupled to the second movable blade 52 through a gear train 28 configured of a plurality of gears, and a second movable blade drive gear 33. The second movable blade drive gear 33 is formed in a general disc-shape. The second movable blade drive gear 33 is rotatably supported on the anchoring plate 38 (see FIG. 6). The rotational drive of the second movable blade drive motor 27B in the forward and reverse directions is transmitted to the second movable blade drive gear 33 via the gear train 28, causing the second movable blade drive gear 33 to rotate (oscillate) within a prescribed angle. A grooved cam 332 is formed in the front surface of the second movable blade drive gear 33. The grooved cam 332 extends outward from a point near the rotational center of the second movable blade drive gear 33. A pin (not illustrated) is provided on the bottom portion of the second movable blade 52. The pin extends rearward from the second movable blade 52 and is engaged in the grooved cam 332 of the second movable blade drive gear 33. When the second movable blade drive gear 33 rotates a prescribed angle, the position of the grooved cam 332 moves relative to the rotational center of the second movable blade drive gear 33, causing the position of the pin on the second movable blade 52 engaged in the grooved cam 332 to move in the left and right directions. In other words, when the output shaft of the second movable blade drive motor 27B rotates in the forward direction and the reverse direction, the second movable blade 52 rotates (oscillates) about the rotating shaft 36 via the gear train 28 and the second movable blade drive gear 33. The second movable blade drive gear 33 is also provided with a protruding piece 331 that protrudes rearward from the rear surface of the second movable blade drive gear 33. The protruding piece 331 will be described later in greater detail.

A second movable blade sensor 39B is provided on the rear side of the second movable blade drive gear 33. The second movable blade sensor 39B is fixed to the anchoring plate 38 (see FIG. 6) with screws (not illustrated). The second movable blade sensor 39B is a limit switch that has a movable piece 39113, and a fixed piece (not illustrated). When the movable piece 391B moves and contacts the fixed piece, the second movable blade sensor 39B outputs an ON signal. When the movable piece 391B separates from the fixed piece, the second movable blade sensor 39B outputs an OFF signal.

In a retracted position of the second movable blade 52, the blade edge 521 of the second movable blade 52 is separated from the conveying region H of the tape 9. The second movable blade 52 begins moving toward the receiving part 51 from the retracted position and halts in a cut complete position after completing a partial cut of the tape 9 present in the conveying region H. Subsequently, the second movable blade 52 returns to the retracted position from the cut complete position and remains halted in the retracted position. In the present embodiment, this series of operations performed by the second movable blade 52 will be called a cut operation.

When the second movable blade 52 is in the retracted position, the protruding piece 331 pushes against the movable piece 391B of the second movable blade sensor 39B (see FIG. 5), and the movable piece 391B is in contact with the fixed piece. Accordingly, the second movable blade sensor 39B outputs an ON signal. If the second movable blade drive motor 27B is driven to rotate a prescribed amount in the forward direction in this state, the second movable blade drive gear 33 is rotated counterclockwise in a front-side view, and the movable piece 391B of the second movable blade sensor 39B separates from the protruding piece 331. Accordingly, the second movable blade sensor 39B outputs an OFF signal. The second movable blade 52 moves to the cut complete position as the second movable blade drive gear 33 rotates counterclockwise in a front-side view and is halted in the cut complete position. Subsequently, when the second movable blade drive motor 27B is driven to rotate a prescribed amount in the reverse direction, the second movable blade drive gear 33 rotates clockwise in a front-side view, and the second movable blade 52 returns from the cut complete position to the retracted position. When the second movable blade 52 returns to the retracted position, the protruding piece 331 presses against the movable piece 391B of the second movable blade sensor 39B, and the second movable blade sensor 39B outputs an ON signal in place of the OFF signal. Hence, the second movable blade sensor 39B can detect when the second movable blade 52 has returned to the retracted position.

Next, the movements in the cutting operations of the first movable blade 42 and second movable blade 52 will be described with reference to FIGS. 7A through 7E and FIGS. 8A through 8E. In the following description, the first movable blade 42 and second movable blade 52 will be collectively referred to as the "movable blades 34." Note that FIGS. 7A through 7E and FIGS. 8A through 8E do not illustrate any members disposed rearward of the open area 10 in the area that is visible through the discharge opening 11.

Figure 7B:
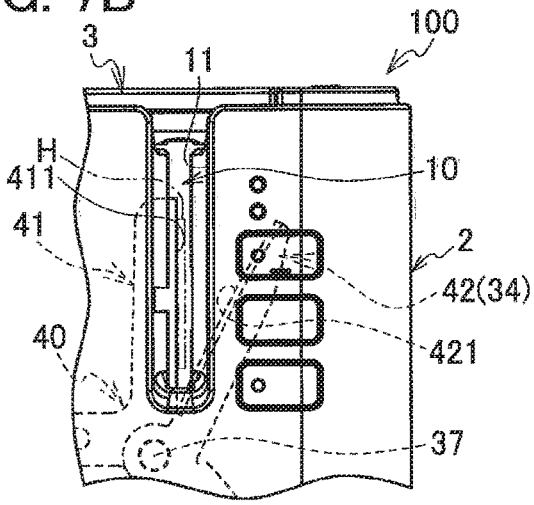
FIG. 7B illustrates a partial view of the front side of the printing device according to the embodiment when the first movable blade is in a retracted position.
Figure 7E:
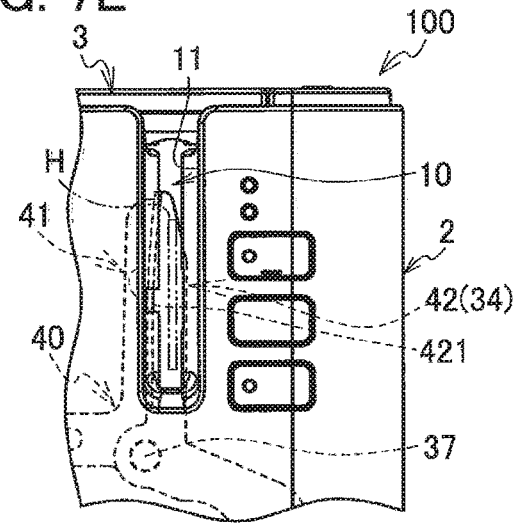
FIG. 7E illustrates a partial view of the front side of the printing device according to the embodiment when the first movable blade is in a cut complete position.
Figure 7C:
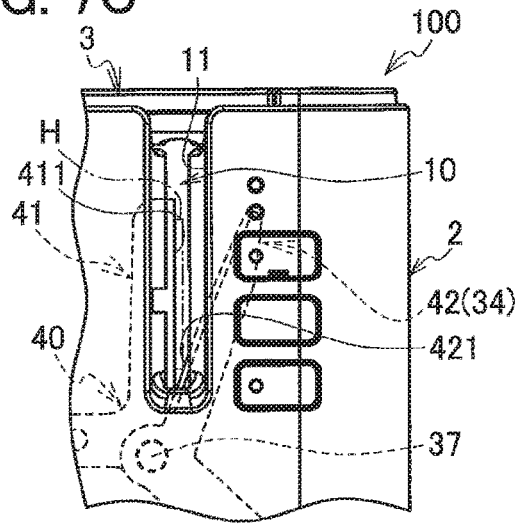
FIG. 7C illustrates a partial view of the front side of the printing device according to the embodiment when the first movable blade is in a cut start position.

As illustrated in FIGS. 7A through 7E, the first movable blade 42 can rotate about the rotating shaft 37 between a maximum separation position (see FIG. 7A) and the cut complete position (see FIG. 7E). The maximum separation position of the first movable blade 42 is the position in which the first movable blade 42 is separated farthest from the conveying region H within the range of movement of the first movable blade 42. The retracted position (see FIG. 7B) is between the maximum separation position and the cut complete position. The range of movement of the first movable blade 42 corresponds to the "movable range" of the present disclosure.

As illustrated in FIG. 7B, the upper portion of the first movable blade 42 is separated rightward from the upper portion of the fixed blade 41 when the first movable blade 42 is in the retracted position. In this position, the first movable blade 42 is outside of the conveying region H and not visible through the discharge opening 11. As illustrated in FIG. 7E, the blade edge 421 of the first movable blade 42 contacts and overlaps the front side of the blade edge 411 of the fixed blade 41 when the first movable blade 42 is in the cut complete position. In this position, the first movable blade 42 is disposed inside the conveying region H and is visible through the discharge opening 11.

With the first cutting blade 40 of the present embodiment, the first movable blade 42 is disposed in the retracted position (FIG. 7B) when not performing a cutting operation. When a cutting operation is initiated, the first movable blade 42 rotates from the retracted position toward the cut complete position (FIG. 7E) so as to approach the fixed blade 41. The first movable blade 42 passes through a cut start position (see FIG. 7C) before arriving at the cut complete position. In the cut start position, the first movable blade 42 enters the lower-right corner of the conveying region H in a front-side view. When the first movable blade 42 is in the cut complete position, the tape 9 is interposed between the blade edge 411 of the fixed blade 41 and the blade edge 421 of the first movable blade 42. Through this operation, a full cut is completed. In a full cut, all layers of the tape 9 are cut between the fixed blade 41 and first movable blade 42. After completing the full cut, the first movable blade 42 rotates back from the cut complete position to the retracted position, thereby completing the cutting operation.

Figure 8A:
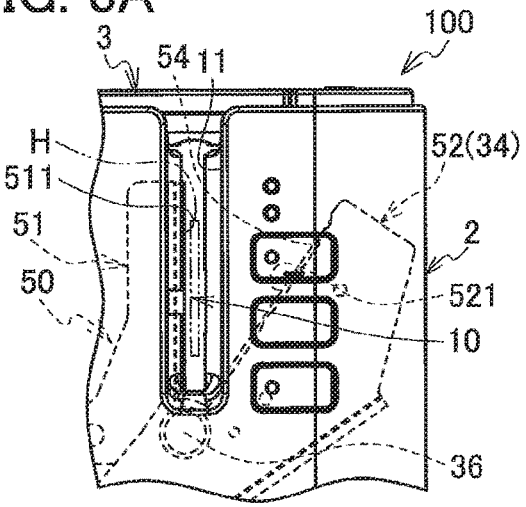
FIG. 8A illustrates a partial view of the front side of the printing device according to the embodiment when a second movable blade is in a maximum separation position.
Figure 8D:
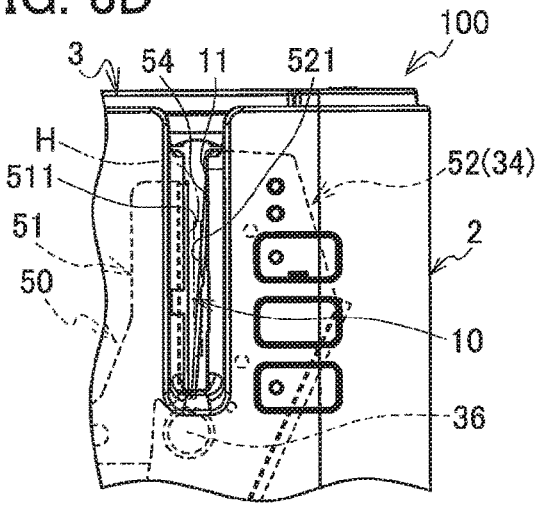
FIG. 8D illustrates a partial view of the front side of the printing device according to the embodiment when the second movable blade is in an abnormal position.
Figure 8B:
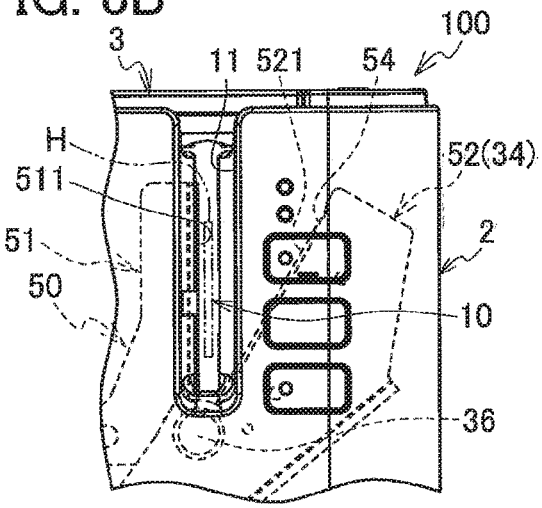
FIG. 8B illustrates a partial view of the front side of the printing device according to the embodiment when the second movable blade is in a retracted position.
Figure 8E:
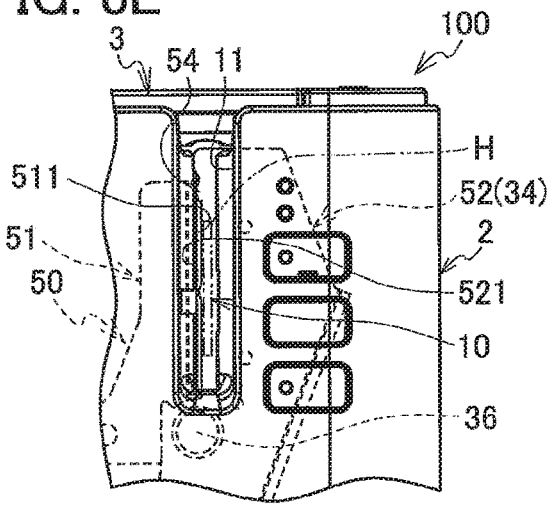
FIG. 8E illustrates a partial view of the front side of the printing device according to the embodiment when the second movable blade is in a cut complete position.
Figure 8C:
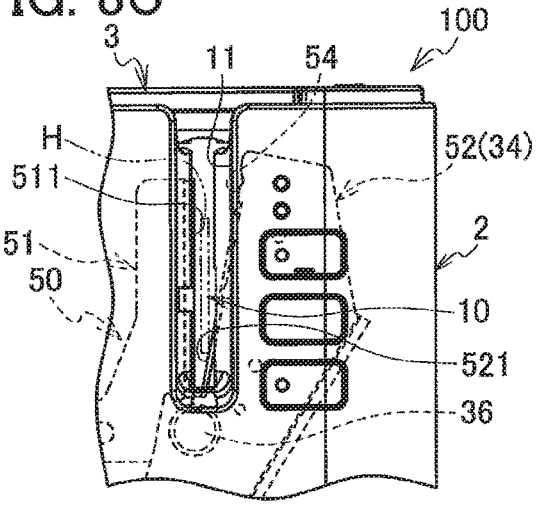
FIG. 8C illustrates a partial view of the front side of the printing device according to the embodiment when the second movable blade is in a cut start position.

As illustrated in FIGS. 8A through 8E, the second movable blade 52 can rotate about the rotating shaft 36 between a maximum separation position (see FIG. 8A) and a cut complete position (see FIG. 8E). The retracted position (see FIG. 8B) is a position between the maximum separation position and the cut complete position. The range of movement of the second movable blade 41 corresponds to the "movable range" of the present disclosure.

As illustrated in FIG. 8B, the upper portion of the second movable blade 52 is separated rightward from the upper portion of the receiving part 51 when the second movable blade 52 is in the retracted position. In this position, the second movable blade 52 is outside of the conveying region H and is not visible through the discharge opening 11. As illustrated in FIG. 8E, the protruding part 54 of the second movable blade 52 contacts the placement surface 511 of the receiving part 51 from the right side when the second movable blade 52 is in the cut complete position. Consequently, a prescribed gap is formed between the placement surface 511 and the blade edge 521 of the second movable blade 52. In other words, the blade edge 521 of the second movable blade 52 is adjacent to but separated a prescribed gap from the placement surface 511 when the second movable blade 52 is in the cut complete position. In this position, the second movable blade 52 is disposed inside the conveying region H and is visible through the discharge opening 11. In the present embodiment, the prescribed gap is smaller than the thickness of the tape 9 and approximately equivalent to the thickness of the release paper 96.

With the second cutting blade 50 of the present embodiment, the second movable blade 52 is disposed in the retracted position (FIG. 8B) when the second movable blade 52 is not performing a cutting operation. When a cutting operation is initiated, the second movable blade 52 rotates from the retracted position toward the cut complete position (FIG. 8E) so as to approach the receiving part 51. The second movable blade 52 passes through a cut start position (see FIG. 8C) at which the second movable blade 52 begins to contact the tape 9 prior to arriving at the cut complete position. In the cut start position, the second movable blade 52 enters the lower-right corner of the conveying region H in a front-side view. When the second movable blade 52 is in the cut complete position, the tape 9 is arranged in the prescribed gap. The tape 9 is pressed against the placement surface 511 of the receiving part 51 by the blade edge 521 of the second movable blade 52. Through this operation, a partial cut is completed. In a partial cut, some layers of the tape 9 on the blade edge 521 side (the printing base material 91, adhesive layer 93, background base material 94, and adhesive layer 95) are cut between the receiving part 51 and second movable blade 52. After completing the partial cut, the second movable blade 52 rotates back from the cut complete position to the retracted position, thereby completing the cutting operation.

Next, a procedure for printing with the printing device 100 will be described with reference to FIGS. 2 and 3. The user places the cover 3 in the open position, exposing the cartridge holder 6 and recessed area 15 from above. The user mounts the tape cassette 7 in the cartridge holder 6. At this time, the ribbon take-up shaft 61 is inserted into the ribbon take-up spool 71, and the tape drive shaft 62 is inserted into the tape drive roller 72. Thereafter, the user closes the cover 3. When the cover 3 is closed, the platen roller 65 and sub-roller 66 move to positions adjacent to the corresponding thermal head 25 and tape drive shaft 62. Through this operation, the platen roller 65 presses the printing base material 91 and the ink ribbon against the thermal head 25 so that the ink ribbon is contacting the printing surface side of the printing base material 91. The adhesive tape 92 is placed over the printing surface side of the printing base material 91 between the sub-roller 66 and tape drive roller 72, forming the tape 9. The sub-roller 66 presses the tape 9 against the tape drive roller 72.

When placed in the closed position, the cover 3 covers the tops of the cartridge holder 6 and the recessed area 15 (see FIG. 1). Hence, when in the closed position, the cover 3 covers the entry opening 12 and tape-insertion opening 13 but not the discharge opening 11, so that the recessed area 15 is exposed through the discharge opening 11.

Although not illustrated in the drawings or described in detail herein, the printing device 100 is connected to and capable of communicating through wires or wirelessly with an external terminal, such as a personal computer, a tablet computer, or a smartphone. The printing device 100 receives print data transmitted from the external terminal.

The printing device 100 prints on the tape 9, while conveying the same, according to the print data received from the external terminal. Specifically, the printing device 100 applies heat to the ink ribbon by heating the thermal head 25, whereby ink in the ink ribbon is thermally transferred onto the printing base material 91 to print characters and other information. The printing device 100 rotates the ribbon take-up shaft 61 and tape drive shaft 62 by driving the tape drive motor 26 (see FIG. 9). Through the rotation of the ribbon take-up shaft 61, the ribbon take-up spool 71 is rotated and takes up the used ink ribbon. Through the rotation of the tape drive shaft 62, the tape drive roller 72 is rotated and conveys the tape 9 pinched between the tape drive roller 72 and the sub-roller 66.

The tape 9 is conveyed such that the longitudinal dimension is oriented in the front-rear direction, the latitudinal dimension is oriented in the vertical direction, and the thickness dimension is oriented in the left-right direction. Specifically, the printing base material 91 side of the tape 9 faces rightward (toward the first movable blade 42 and second movable blade 52), while the adhesive tape 92 side faces leftward (toward the fixed blade 41 and receiving part 51). After being discharged from the tape cassette 7, the printed tape 9 enters the open area 10 through the entry opening 12.

Figure 9:
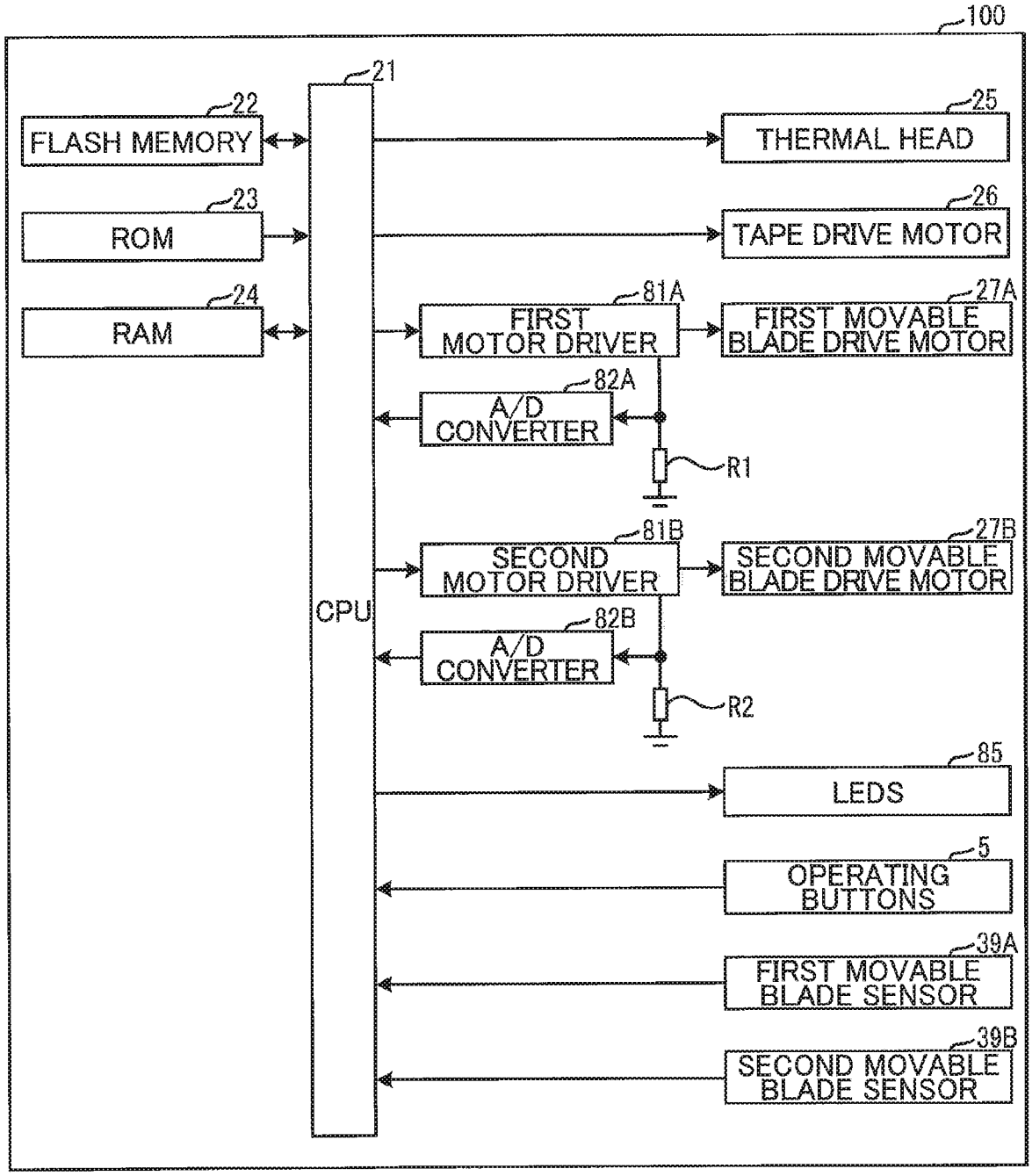
FIG. 9 is a block diagram illustrating an electrical configuration of the printing device according to the embodiment.

The printing device 100 moves the first movable blade 42 or the second movable blade 52 from its retracted position to its cut complete position (see FIGS. 7A through 7E and FIGS. 8A through 8E) by driving the corresponding first movable blade drive motor 27A or second movable blade drive motor 27B (see FIG. 9). Through this operation, either the first cutting blade 40 performs a full cut or the second cutting blade 50 performs a partial cut through the printed tape 9. The cut tape 9 is discharged from the printing device 100 through the discharge opening 11.

The printing device 100 is also provided with a non-cutting mode that suspends the cutting operations described above. The user can switch the printing device 100 to the non-cutting mode by operating the operating buttons 5. When the printing device 100 is in the non-cutting mode, the printed tape 9 is not cut by the cutting device 1 after being discharged from the tape cassette 7, and the uncut tape 9 enters the entry opening 12, passes through the open area 10, and is discharged from the printing device 100 via the discharge opening 11. The non-cutting mode will be described later in greater detail.

Next, the electrical configuration of the printing device 100 will be described with reference to FIG. 9. The printing device 100 is provided with a central processing unit (CPU) 21. The CPU 21 performs overall control of the printing device 100. The CPU 21 is connected to a flash memory 22, a read only memory (ROM) 23, a random access memory (RAM) 24, and the like. The flash memory 22 stores various programs and the like, including a program for instructing the CPU 21 to execute a main process described later. The ROM 23 stores various parameters required when the CPU 21 executes the various programs. The RAM 24 stores temporary data, such as timers and counters.

The CPU 21 is also connected to the operating buttons 5, the first movable blade sensor 39A, the second movable blade sensor 39B, an A/D converter 82A, and an A/D converter 82B. The operating buttons 5, first movable blade sensor 39A, second movable blade sensor 39B, A/D converter 82A, and A/D converter 82B input information required for control into the CPU 21.

The CPU 21 is also connected to the thermal head 25, the tape drive motor 26, a first motor driver 81A, a second motor driver 81B, and the LEDs 85. The CPU 21 outputs information necessary for controlling the thermal head 25, tape drive motor 26, first motor driver 81A, second motor driver 81B, and LEDs 85.

The first motor driver 81A is connected to the first movable blade drive motor 27A, the A/D converter 82A, and one end of a resistor R1. The first motor driver 81A is a driver device for driving the first movable blade drive motor 27A in response to control signals outputted by the CPU 21. The first motor driver 81A outputs a current equivalent to the current conducted to the first movable blade drive motor 27A. The outputted current is supplied to the resistor R1. In this case, a voltage corresponding to the outputted current is generated across both ends of the resistor R1. The AID converter 82A converts the voltage level generated in the resistor R1 from an analog value to a digital value and outputs the digital value to the CPU 21. Accordingly, the CPU 21 can identify the voltage generated across the ends of the resistor R1 based on the digital value obtained from the A/D converter 82A and can detect the current being conducted to the first movable blade drive motor 27A based on the relationship between the identified voltage and the resistor R1. Therefore, the A/D converter 82A can detect when an overcurrent is being conducted to the first movable blade drive motor 27A.

The second motor driver 81B is connected to the second movable blade drive motor 27B, the A/D converter 82B, and one end of a resistor R2. The second motor driver 81B is a driver device for driving the second movable blade drive motor 27B in response to control signals outputted by the CPU 21. The second motor driver 81B outputs a current equivalent to the current conducted to the second movable blade drive motor 27B. The outputted current is supplied to the resistor R2. The A/D converter 82B converts the voltage level generated in the resistor R2 from an analog value to a digital value and outputs the digital value to the CPU 21. Therefore, as with the A/D converter 82A, the A/D converter 82B can detect when an overcurrent is being conducted to the second movable blade drive motor 27B.

Next, the main process will be described with reference to FIGS. 10 through 16. The user operates the operating buttons 5 in order to perform the main process. When the CPU 21 receives a start command from the operating buttons 5 to perform the main process, the CPU 21 reads a program for executing the main process from the flash memory 22 and executes the main process.

Figure 10:
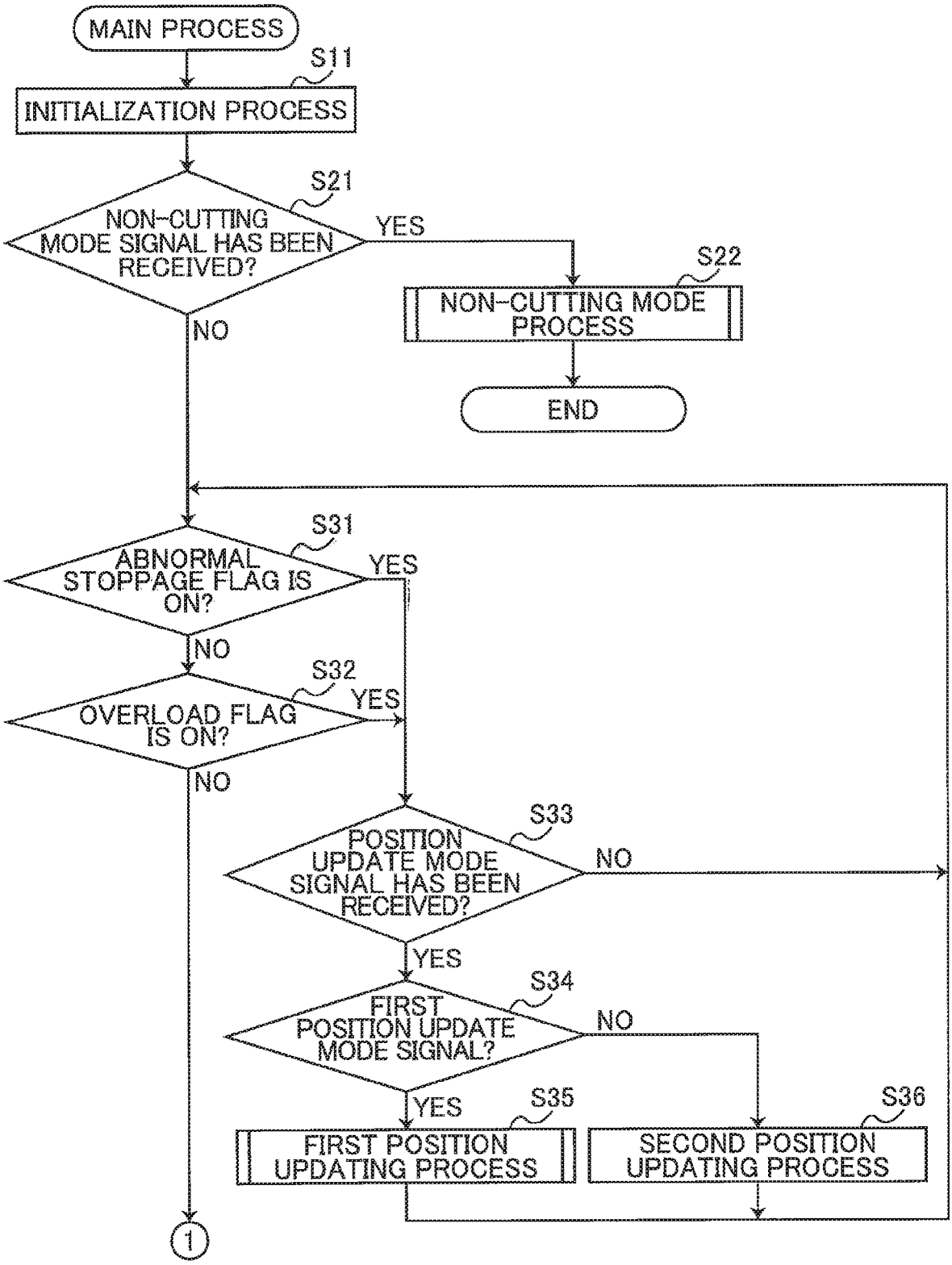
FIG. 10 is a flowchart illustrating part of steps in a main process executed by a CPU of the printing device according to the embodiment.
Figure 11:
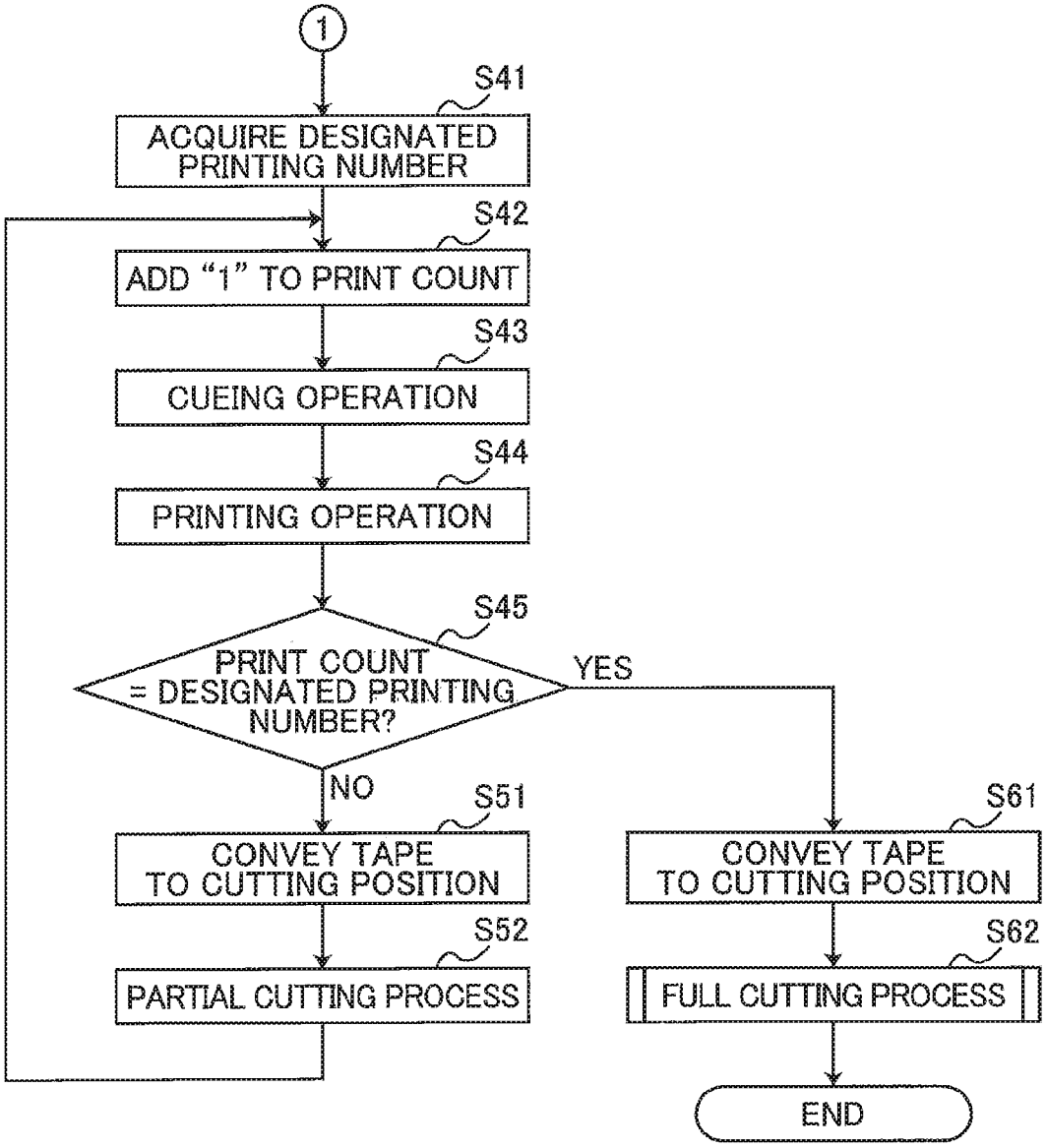
FIG. 11 is a flowchart illustrating remaining steps in the main process executed by the CPU of the printing device according to the embodiment.

In S11 of FIG. 10, the CPU 21 performs an initialization process. In the initialization process, the CPU 21 sets the cutting device 1 to an initial state by controlling the first movable blade drive motor 27A and second movable blade drive motor 27B through the first motor driver 81A and second motor driver 81B, respectively. When the cutting device 1 is in the initial state, the movable blades 34 are in their retracted positions. Additionally, timer and counter values are reset and stored in the RAM 24.

In. S21 the CPU 21 determines whether a non-cutting mode signal has been received. The user operates the operating buttons 5 when changing the mode of the printing device 100 to the non-cutting mode. If the CPU 21 has received a non-cutting mode signal from the operating buttons 5 (S21: YES), in S22 the CPU 21 performs a non-cutting mode process described later, and subsequently ends the main process.

When the CPU 21 has not received a non-cutting mode signal (S21: NO), in S31 the CPU 21 determines whether an abnormal stoppage flag is set to "ON". The abnormal stoppage flag is a flag stored in the RAM 24 that indicates whether one of the movable blades 34 was halted in an abnormal position described later during a cutting operation. The abnormal stoppage flag is "ON" when at least one of the first movable blade 42 and second movable blade 52 stopped in an abnormal position. The abnormal stoppage flag is set to "OFF" when the CPU 21 executes a first position updating process (S35) or a second position updating process (S36) described later.

When the abnormal stoppage flag is "OFF" (S31: NO), in 532 the CPU 21 determines whether an overload flag is set to "ON". The overload flag is a flag stored in the RAM 24 that indicates whether the current supplied to the first movable blade drive motor 27A and second movable blade drive motor 27B is an overcurrent. The overload flag is set to "ON" when the current supplied to at least one of the first movable blade drive motor 27A and second movable blade drive motor 27B and identified from the output of the corresponding A/D converter 82A and A/D converter 82B is an overcurrent. The overload flag is set to "OFF" when the CPU 21 executes the first position updating process (S35) or the second position updating process (S36).

When the abnormal stoppage flag is "OFF" (S31: NO) and the overload flag is "OFF" (S32: NO), in S41 of FIG. 11 the CPU 21 acquires a designated printing number. The designated printing number indicates the number of times that the printing device 100 should repeat the printing operation. The user inputs the designated printing number via the operating buttons 5.

In S42 the CPU 21 adds "1" to a print count and stores this print count in the RAM 24. The print count denotes the number of printing operations executed by the printing device 100. The CPU 21 resets this print count to "0" in the initialization process of S11 (see FIG. 10). In S43 the CPU 21 executes a cueing operation. In the cueing operation, the tape drive motor 26 is driven to convey the tape 9 to the position at which printing will begin. In S44 the CPU 21 executes the printing operation. Through this operation, characters and other information are printed on the tape 9.

In. S45 the CPU 21 determines whether the print count has reached the designated printing number. If the print count has not yet reached the designated printing number (S45: NO), in S51 the CPU 21 drives the tape drive motor 26 to convey the tape 9 to a cutting position. The cutting position is the position at which the cutting device 1 can cut the printed portion of the tape 9.

In S52 the CPU 21 executes a partial cutting process. In this process, the second cutting blade 50 of the cutting device 1 performs a partial cut through the tape 9. Subsequently, the CPU 21 returns to S42 and repeats the process described above. While the print count has not reached the designated printing number (S45: NO), the CPU 21 repeatedly executes the printing operation and the partial cutting operation in S51, S52, and S42 through S44.

When the print count reaches the designated printing number (S45: YES), in S61 the CPU 21 conveys the printed tape 9 to the cutting position.

In S62 the CPU 21 executes a full cutting process. In this process, the first cutting blade 40 of the cutting device 1 performs a full cut through the tape 9. After completing the full cutting process, the CPU 21 ends the main process.

The details of the partial cutting process of S52 and the full cutting process of S62 are essentially the same, and differ only in whether the second cutting blade 50 performs the cutting operation or the first cutting blade 40 performs the cutting operation. Therefore, only the fill cutting; process will be described in the present embodiment, while a description of the partial cutting process will be omitted.

The full cutting process will be described with reference to FIGS. 12 and 13. In S101 of FIG. 12, the CPU 21 acquires a moving time T from the flash memory 22. The moving time T is the drive time for the first movable blade drive motor 27A when the first movable blade 42 performs the cutting operation, In S102 the CPU 21 acquires a stop time ST from the ROM 23. The stop time ST is the time required for the first movable blade drive motor 27A to come to a stop after deceleration begins during driving. In S103 the CPU 21 sets an operating time counter to "0" and starts measurements with the operating time counter. The operating time counter tracks the operating time that has elapsed since the full cutting process was begun. In Sill the CPU 21 begins driving the first movable blade drive motor 27A to start the cutting operation with the first movable blade 42.

Figure 13:
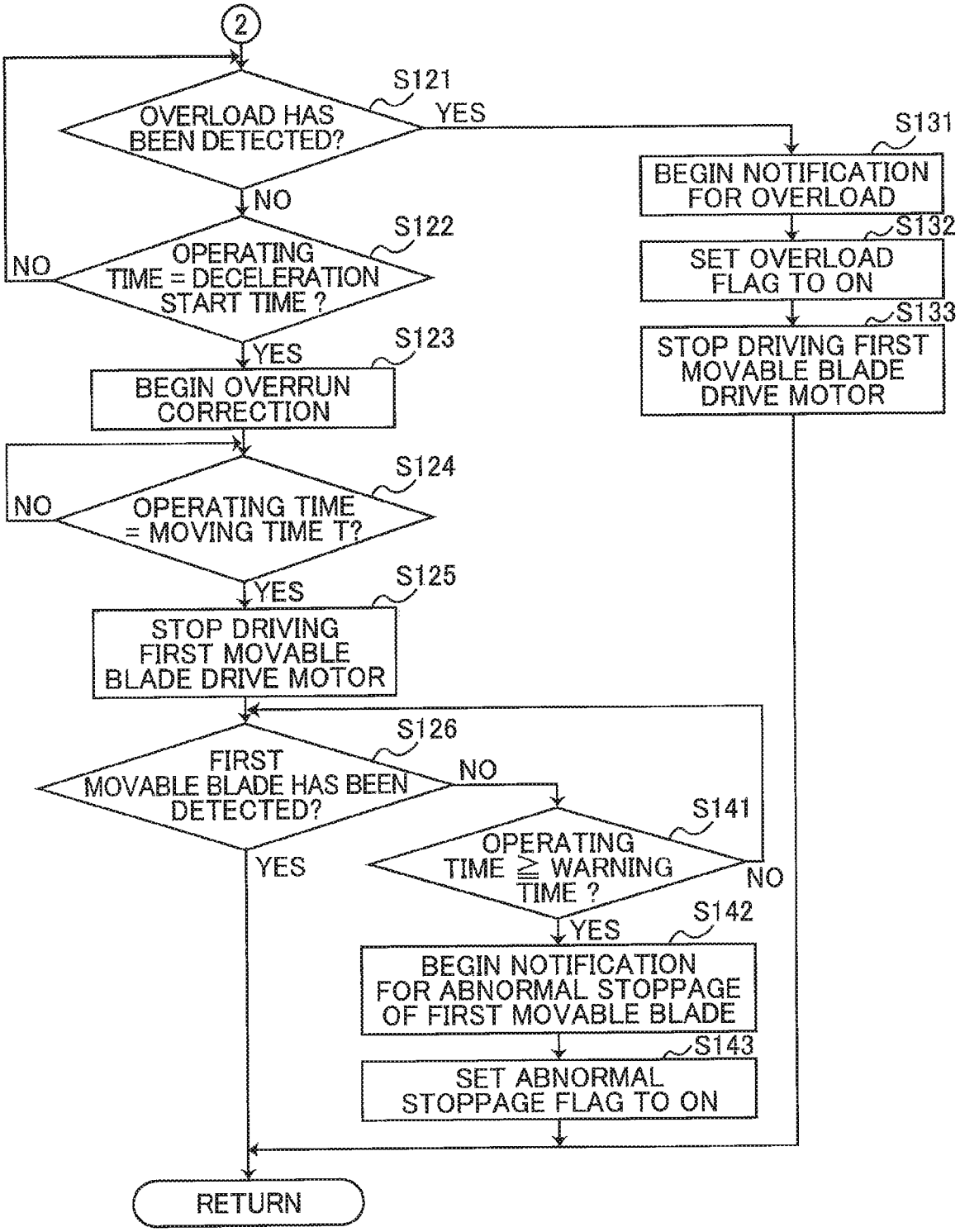
FIG. 13 is a flowchart illustrating remaining steps in the full cutting process executed during the main process by the CPU of the printing device according to the embodiment.

In S121 of FIG. 13, the CPU 21 determines whether an overload on the first movable blade drive motor 27A has been detected on the basis of the magnitude of current being conducted to the first movable blade drive motor 27A. The A/D converter 82A detects this current.

When the CPU 21 does not detect an overload on the first movable blade drive motor 27A (S121: NO), in S122 the CPU 21 determines whether the operating time has reached a deceleration start time on the basis of the value of the operating time counter set in S103. The deceleration start time is the amount of time from When the first movable blade drive motor 27A starts driving until the first movable blade drive motor 27A starts decelerating. The deceleration start time is calculated as (moving time T)—(stop time ST). In a normal cutting operation, the first movable blade 42 will be moving from the cut complete position toward the retracted position when the operating time reaches the deceleration start time. If the operating time has not yet reached the deceleration start time (S122: NO), the CPU 21 returns to S121 and repeats the process from S121.

When the operating time has reached the deceleration start time (S122: YES), in S123 the CPU 21 begins overrun correction. If the first movable blade drive motor 27A were to be abruptly halted once the moving time T had elapsed, the first movable blade 42 might overrun the retracted position due to its inertia. Overrun correction controls the deceleration of the first movable blade drive motor 27A in order to prevent the first movable blade 42 from overrunning the retracted position. Since the CPU 21 begins overrun correction before the moving time T has elapsed, the CPU 21 can halt the first movable blade drive motor 27A once the operating time has reached the moving time T, thereby stopping the first movable blade 42 at the retracted position.

In S124 the CPU 21 determines whether the operating time has reached the moving time T on the basis of the value of the operating time counter set in S103. The CPU 21 continually repeats the determination in S 124 as long as the operating time has not yet reached the moving time T (S124: NO). When the operating time has reached the moving time T (S124: YES), in S125 the CPU 21 stops driving the first movable blade drive motor 27A.

In S126 the CPU 21 determines whether the first movable blade 42 has been detected. The CPU 21 can make this determination because the first movable blade sensor 39A outputs an ON signal to the CPU 21 upon detecting the first movable blade 42 after a cutting operation was begun. In a normal cutting operation, the first movable blade sensor 39A detects the first movable blade 42 once the operating time has reached the moving time T (S124: YES) since the first movable blade drive motor 27A is halted (S125) with the first movable blade 42 in the retracted position. If the first movable blade 42 is detected (S126: YES), the CPU 21 returns to the main process of FIG. 11 since the first movable blade 42 is now in the retracted position.

If the first movable blade 42 is not detected (S126: NO), in 5141 the CPU 21 determines whether the operating time has reached a warning time. This determination is made on the basis of the value of the operating time counter that was set in S103. The warning time is a value set sufficiently longer than the moving time T and is pre-stored in the ROM 23. If the operating time exceeds the warning time without the first movable blade 42 being detected, the CPU 21 determines that a normal cutting operation could not be completed and that the first movable blade 42 has stopped in an abnormal position described later. If the operating time has not yet reached the warning time (S141: NO), the CPU 21 returns to S126 and continues monitoring the operating time. The warning time corresponds to the "prescribed time" of the present disclosure.

If the operating time has reached the warning time (S141: YES), in S142 the CPU 21 determines that the first movable blade 42 stopped in an abnormal position and notifies the user of this abnormal stoppage by lighting LEDs 85. This notification is continued until the first position updating process described later (S35 of FIG. 10) is performed. In S143 the CPU 21 sets the abnormal stoppage flag to "ON" and subsequently returns to the main process.

On the other hand, if the CPU 21 detects an overload on the first movable blade drive motor 27A (S121: YES), in S131 the CPU 21 notifies the user of the detected overload by lighting LEDs 85. This notification is continued until the first position updating process (described later) is performed. In S132 the CPU 21 sets the overload flag to "ON", and in S133 halts the drive of the first movable blade drive motor 27A. Subsequently, the CPU 21 returns to the main process.

Here, a case in which the first movable blade 42 was halted in an abnormal position will be described. Occasionally, the first movable blade 42 may stop in an abnormal position during a full cutting process. An abnormal position is a position between the cut start position and the cut complete position (see FIGS. 7D and 8D). One possible reason for the first movable blade 42 stopping in an abnormal position (see FIG. 7D) is that the tape 9 has become jammed in the open area 10 and the first movable blade 42 is unable to cut the tape 9. Another possible reason is that the first movable blade sensor 39A is itself defective or that the mounted position of the first movable blade sensor 39A has shifted for some reason and the position at which the first movable blade sensor 39A detects the first movable blade 42 is an abnormal position. Alternatively, the first movable blade 42 could be stopped during the cutting operation due to overload and the position at which the first movable blade 42 is halted may be an abnormal position. Similarly, in the partial cutting process (S52 of FIG. 11), the second movable blade 52 may also be halted in an abnormal position (see FIG. 8D) due to jamming of the tape 9, defectiveness or deviation in the mounting position of the second movable blade sensor 39B, or overload. The abnormal position corresponds to the "intervening position" of the present disclosure.

As described above, the CPU 21 determines that the first movable blade 42 stopped in an abnormal position if the first movable blade 42 has not been detected when the operating time exceeds the warning time. Since the CPU 21 notifies the user that the first movable blade 42 stopped in an abnormal position by lighting the LEDs 85, the user can recognize that the first movable blade 42 was halted in an abnormal position without having to confirm the position of the first movable blade 42 visually through the discharge opening 11 after the cutting operation. Note that since the user can visually confirm the position of the first movable blade 42 through the discharge opening 11 after a cutting operation, users can determine themselves whether the first movable blade 42 was halted in an abnormal position, even if the notification process of S142 were omitted. The same holds true for the second movable blade 52.

When the user recognizes that the first movable blade 42 was halted in an abnormal position from the notification by the CPU 21 (S142), for example, the user will realize that a subsequent cutting operation cannot be performed in this state since the first movable blade 42 is not in the retracted position. In other words, the CPU 21 does not know the current position of the first movable blade 42 and, hence, cannot properly perform a cutting operation. Further, when stopped in an abnormal position, the first movable blade 42 is inside the conveying region II. In this state, the user may be unable to mount or remove the tape cassette 7 properly. In certain cases, the tape 9 may not have been fully cut through and may still be interposed between the fixed blade 41 and first movable blade 42. Further, if the tape cassette 7 is temporarily removed and subsequently remounted, the first movable blade 42 stopped in the abnormal position may obstruct the tape 9. Accordingly, the user must move the first movable blade 42 at least to a position outside of the conveying region H and set this position as a new retracted position.

Hence, the user must perform prescribed operations on the operating buttons 5 in order to return the first movable blade 42 to a suitable position. When input for the prescribed operations is received, the operating buttons 5 transmit a position update mode signal to the CPU 21.

Specifically, the user operates the operating buttons 5 in order to perform the main process. When a start command is received from the operating buttons 5, the CPU 21 executes the main process. In S11 the CPU 21 performs the initialization process, and in. S21 determines whether a non-cutting mode signal has been received. When a non-cutting mode signal has not been received (S21: NO), the CPU 21 determines in S31 whether the abnormal stoppage flag is set to "ON" and in S32 whether the overload flag is set to "ON". When either of the abnormal stoppage flag and overload flag is "ON" (S31: YES or 532: YES), in S33 the CPU 21 determines whether a position update mode signal has been received from the operating buttons 5. The position update mode signal is received when the user issues a command to execute a position updating process through an operation on the operating buttons 5. While a position update mode signal has not been received (S33: NO), the CPU 21 returns to S31 and performs the above determinations.

When a position update mode signal has been received (S33: YES), in S34 the CPU 21 determines whether the position update mode signal is a first position update mode signal. That is, when operating the operating buttons 5 to issue a command for executing a position updating process, the user selects whether to execute a first position updating process or a second position updating process. Here, the first position updating process is a position updating process performed for adjusting the first movable blade 42, and the second position updating process is a position updating process performed for adjusting the second movable blade 52. When the CPU 21 receives a first position update mode signal specifying execution of the first position updating process (S34: YES), in S35 the CPU 21 executes the first position updating process and returns to S31. If a first position update mode signal was not received (S34: NO), in other words, if the CPU 21 receives a second position update mode signal specifying execution of the second position updating process (S34: NO), in. S36 the CPU 21 executes the second position updating process, and subsequently returns to S31.

Note that even if both the abnormal stoppage flag and the overload flag are "OFF" (S31: NO, S31: NO), the user may still input the position update mode signal via the operating buttons 5 upon noticing that the first movable blade 42 is visible through the discharge opening 11 after a cutting operation. The same holds true if the second movable blade 52 is visible. Thus, the position updating process can be performed even in such cases. For simplification, the following description will cover only the first position updating process and not the second position updating process.

Figure 14:
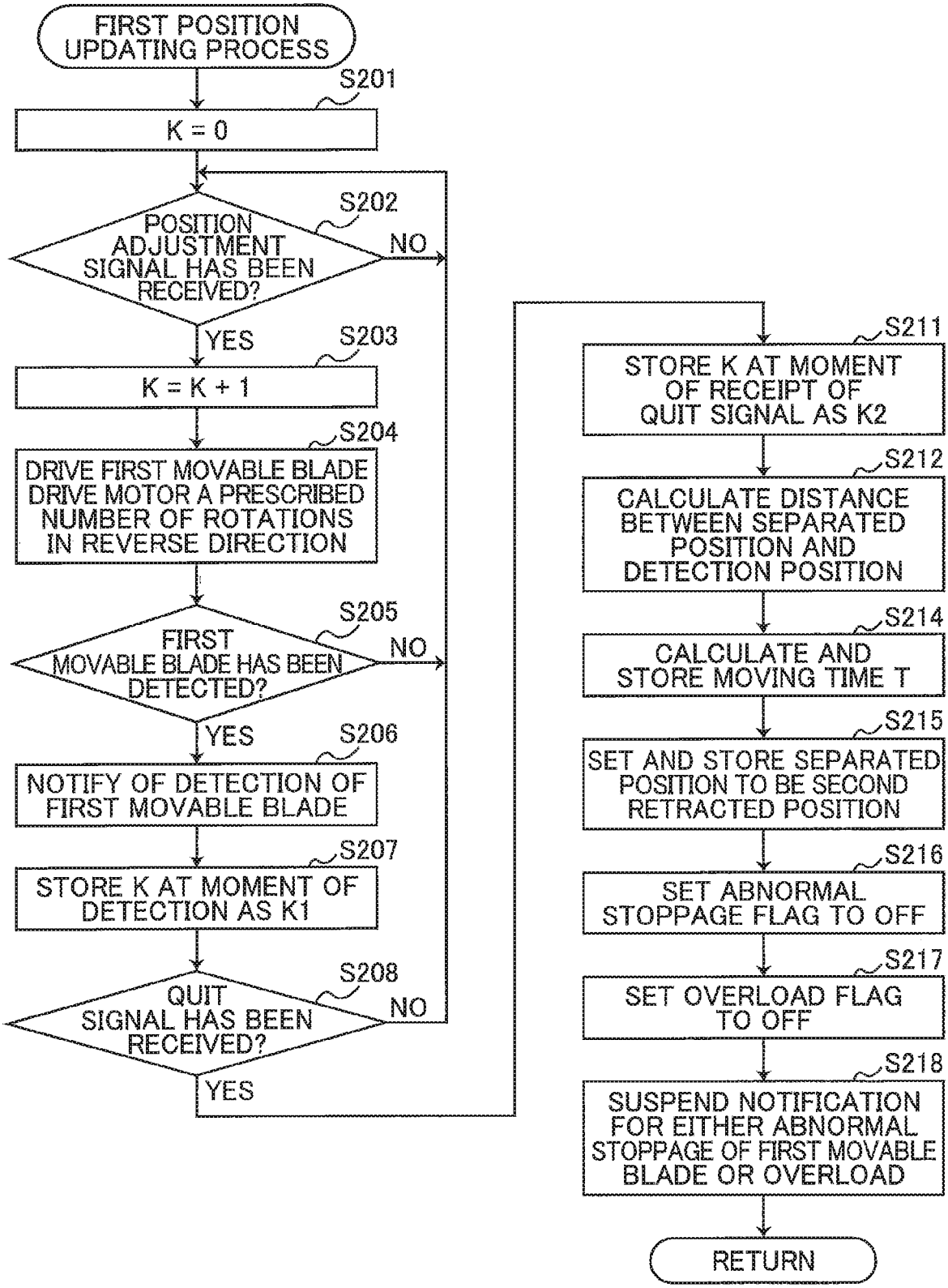
FIG. 14 is a flowchart illustrating steps in a first position updating process executed during the main process by the CPU of the printing device according to the embodiment.

The first position updating process will be described with reference to FIG. 14. In S201 of FIG. 14, the CPU 21 sets the value for a counter, i.e., a counter value K to "0" and stores the counter value K in the RAM 24. At this time, the user can input a position adjustment signal into the CPU 21 through an operation on the operating buttons 5. The operating buttons 5 output a position adjustment signal each time a specific operating button 5 is pressed, for example. As will be described later, the first movable blade 42 is shifted a prescribed distance in a direction away from the conveying region H (away from the fixed blade 41) each time the user inputs one position adjustment signal. By repeatedly inputting a position adjustment signal, the user can move the first movable blade 42 out of the conveying region H through which the tape 9 is conveyed. In S202 the CPU 21 determines whether a position adjustment signal has been received. When a position adjustment signal has not been received (S202: NO), the CPU 21 returns to S202 and continues to wait for a signal.

When a position adjustment signal has been received (S202: YES), in S203 the CPU 21 increments the counter value K by "1" and stores the counter value Kin the RAM 24. Hence, the value of K denotes the number of times that a position adjustment signal has been received. In S204 the CPU 21 drives the first movable blade drive motor 27A a prescribed number of rotations in the reverse direction. Through the drive force of the first movable blade drive motor 27A, the first movable blade 42 is moved the prescribed distance in the direction away from the fixed blade 41.

In S205 the CPU 21 determines whether the first movable blade 42 has been detected. This determination is identical to the determination in S126 described above (see FIG. 13). When the first movable blade 42 has not been detected (S205: NO), the CPU 21 returns to the determination in S202.

When the first movable blade 42 has been detected (S205: YES), in S206 the CPU 21 notifies the user that the first movable blade 42 has been detected by lighting the LEDs 85, and in S207 stores the value of K at the moment the first movable blade 42 was detected in the RAM 24 as K1. Through the notification in S206, the user can recognize that the first movable blade 42 has been moved to a position detectable by the first movable blade sensor 39A.

If the position that the first movable blade sensor 39A detects the first movable lade 42 is identical to the retracted position preset on the printing device 100 (the first retracted position), the first movable blade 42 is in a separated position and not an abnormal position. A separated position is a position between the cut start position and the maximum separation position and is a position separated from the conveying region H of the tape 9. When the first movable blade 42 is in a separated position, the first movable blade 42 is outside of the conveying region H through which the tape 9 passes and thus is in a normal state. Accordingly, the user operates the operating buttons 5 in order to quit adjustments for the first movable blade 42. In S208 the CPU 21 determines whether a quit signal has been received from the operating buttons 5. If a quit signal has been received (S208: YES), the CPU 21 advances to S211 described later.

However, the position at which the first movable blade sensor 39A detects the first movable blade 42 may differ from the first retracted position. In some cases, the mounted position of the first movable blade sensor 39A may shift, causing the detection position to move to an abnormal position, for example. As described above, when the CPU 21 performs the notification in S206, the first movable blade 42 is in the first retracted position in normal cases. However, when the user can see the first movable blade 42 through the discharge opening 11, it is possible that the first movable blade 42 is still in an abnormal position, but that the position of the first movable blade sensor 39A has deviated. In this case, the user must continue adjusting the position of the first movable blade 42 in order to ensure that the first movable blade 42 is moved completely out of the conveying region H. Accordingly, the user does not input a quit command on the operating buttons 5. Since the CPU 21 does not receive the quit signal from the operating buttons 5 (S208: NO), the CPU 21 returns to S202 and repeats the process described above. The user continues operating the operating buttons 5 to move the first movable blade 42 farther away from the fixed blade 41. Once the first movable blade 42 has moved from an abnormal position to a separated position and can no longer be seen through the discharge opening 11, the user operates the operating buttons 5 to quit adjustments for the first movable blade 42. When the CPU 21 receives the quit signal from the operating buttons 5 (S208: YES), in 5211 the CPU 21 stores the value of the counter K at the timing that the quit signal was received in the RAM 24 as K2.

In 5212 the CPU 21 calculates the distance between the separated position at which the first movable blade 42 is positioned and the detection position at which the first movable blade sensor 39A detected the first movable blade 42. As described above, the distance that the first movable blade 42 is moved by one position adjustment signal is preset. Therefore, the distance between the separated position and the detection position is calculated using the difference between the value of K1 that was stored in S207 and the value of K2 that was stored in S211.

In S214 the CPU 21 calculates the moving time T and stores the moving time T in the flash memory 22. Here, the CPU 21 calculates the moving time T to be the time required for reciprocating the first movable blade 42 between the separated position and the cut complete position. The moving time T is calculated using the distance between the separated position and detection position calculated in S212 and the drive speed of the first movable blade drive motor 27A. The CPU 21 uses this calculated. moving time T for controlling subsequent cutting operations.

In S215 the CPU 21 sets the separated position at which the first movable blade 42 is currently position to be a second retracted position and stores this second retracted position in the flash memory 22 as the new retracted position. In other words, the second retracted position becomes the new retracted position to be used in place of the first retracted position. The moving time T is then updated to he the time required for moving the first movable blade 42 in a cutting operation when the second retracted position is the start point of the operation. Therefore, the first movable blade 42 can start the cutting operation from the second retracted position, turn back at the cut complete position, and stop in the second retracted position. Thus, the first movable blade 42 can be reciprocated between the second retracted position and the cut complete position in subsequent cutting operations.

In S216 the CPU 21 sets the abnormal stoppage flag to "OFF" and in S217 sets the overload flag to "OFF". In S218 the CPU 21 suspends the notification for either the abnormal position of the first movable blade 42 or the overload. Subsequently, the CPU 21 ends the current process.

Next, the non-cutting mode process will be described with reference to FIG. 15. In some cases, the cutting device 1 may not perform a cutting operation properly even after the position updating process described above was executed. That is, the printing operation on the printing device 100 may be performed properly, while only the cutting operation is abnormal. In such cases, the user may operate the operating buttons 5 in order to change the anode of the printing device 100 to the non-cutting mode. The non-cutting mode suspends cutting operations by the cutting device 1. If the CPU 21 determines in S21 of FIG. 10 that a non-cutting mode signal has been received from the operating buttons 5 (S21: YES), in S22 the CPU 21 initiates the non-cutting mode process. Note that the process in S401 through S404 of FIG. 15 is abbreviated in the following description since the process is equivalent to that in S41 through S44 of FIG. 11.

Figure 15:
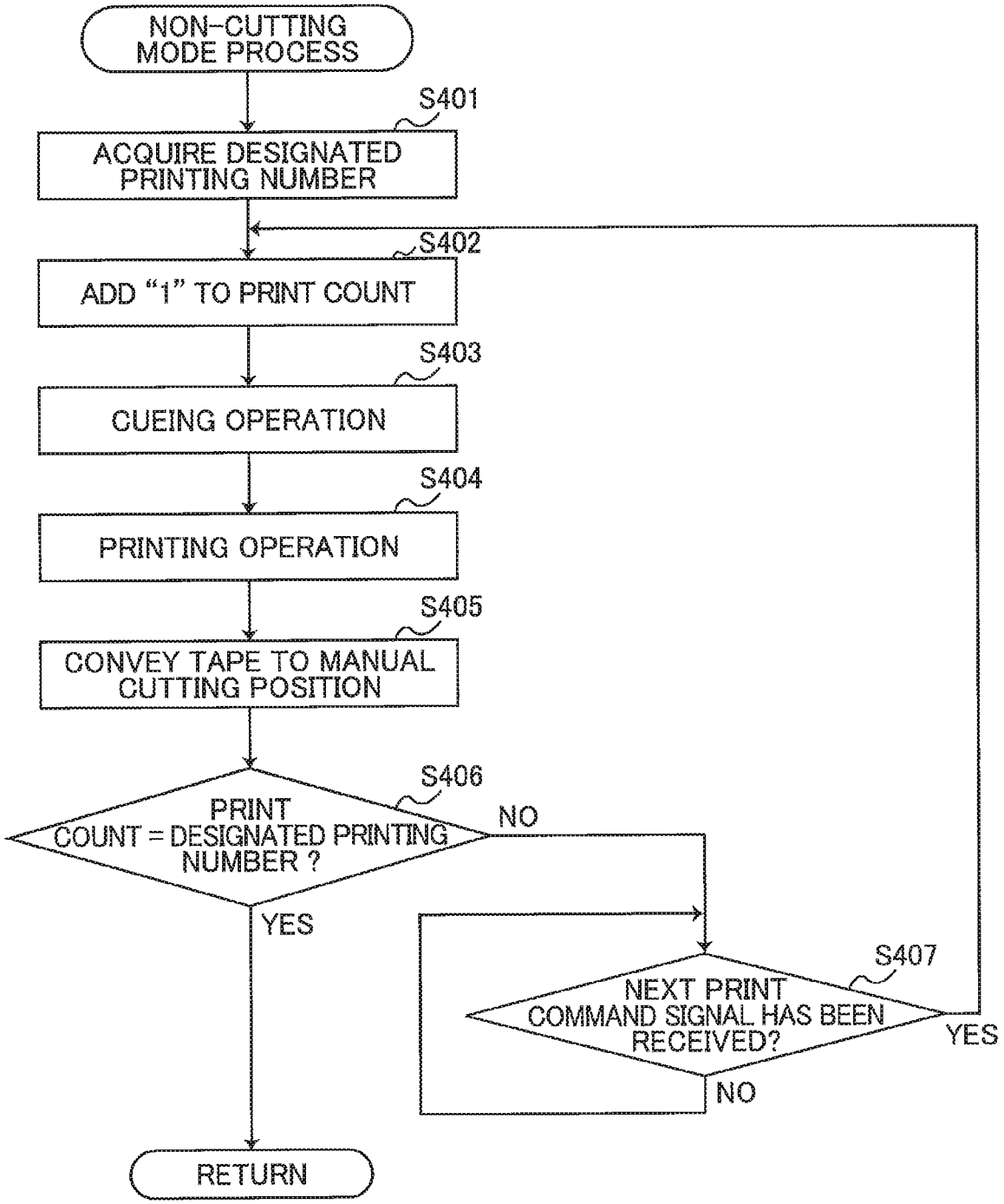
FIG. 15 is a flowchart illustrating steps in a non-cutting mode process executed during the main process by the CPU of the printing device according to the embodiment.

In S401 of FIG. 15, the CPU 21 acquires the designated printing number, In S402 the CPU 21 increments the print count by "1" and stores the print count in the RAM 24. In S403 the CPU 21 executes the cueing process. In S404 the CPU 21 executes the printing operation, thereby printing characters and other information on the tape 9.

In 5405 the CPU 21 conveys the tape 9 to a manual cutting position. The manual cutting position is the position at which the entire portion of the tape 9 that has been printed with characters and other information is discharged from the discharge opening 11. Since cutting operations by the cutting device 1 are suspended in the non-cutting mode, the user uses scissors to cut the tape 9 at the manual cutting position.

In S406 the CPU 21 determines whether the print count has reached the designated printing number. If the print count has not yet reached the designated printing number (S406: NO), in S407 the CPU 21 determines whether a next print command signal has been received. The next print command signal is a command for starting the next printing operation. The user performs an operation on the operating buttons S in order to start the next printing operation. The CPU 21 waits, i.e., continually loops hack to S407, while the next print command signal has not been received from the operating buttons 5 (S407: NO). When the next print command signal is received from the operating buttons 5 (S407: YES), the CPU 21 returns to S402 and executes a similar printing operation to that described above (S402 through S407). When the print count reaches the designated printing number after repeating the above printing operations (S406: YES), the CPU 21 ends the non-cutting mode process and returns to the main process, As described above, when the movable blade 34 (first movable blade 42 or second movable blade 52) stops in an abnormal position, the cutting device 1 moves the movable blade 34 from the abnormal position to a separated position through the position updating process. Next, the cutting device 1 sets this separated position as the second retracted position and stores the second retracted position as the retracted position, thereby enabling the cutting device 1 to perform cutting operations, In some cases, the cutting device 1 may be provided with the first movable blade sensor 39A or second movable blade sensor 39B for detecting when the movable blade 34 is in the first retracted position. If the first movable blade sensor 39A or second movable blade sensor 39B does not detect the corresponding movable blade 34 in the first retracted position, the cutting device 1 moves the movable blade 34 from the abnormal position to a separated position through the position updating process, thereby enabling the cutting device 1 to perform cutting operations.

When the first movable blade sensor 39A or second movable blade sensor 39B cannot detect whether the corresponding movable blade 34 is in the first retracted position because the detection position is in an abnormal position, the CPU 21 calculates the distance between the detection position and the second retracted position. The CPU 21 calculates the moving time T based on the distance between the detection position and the second retracted position and performs control to ensure that the movable blade 34 reaches the second retracted position after completing a cutting operation, thereby enabling the cutting device 1 to perform cutting operations.

If the CPU 21 has not detected the movable blade 34 when the operating time has exceeded the warning time, the CPU 21 determines that the movable blade 34 has stopped in an abnormal position. By determining when the movable blade 34 has stopped in an abnormal position, the CPU 21 can assist the user in recognizing that the movable blade 34 has stopped in an abnormal position.

In this case, the user can operate the operating buttons 5 to input position adjustment signals into the CPU 21. Since the user is performing the operations to move the movable blade 34 to a separated position, the user can readily understand when the movable blade 34 has been moved to a separated position.

The cutting device 1 begins decelerating the first movable blade drive motor 27A or second movable blade drive motor 27B before the moving time T has elapsed, i.e., before the movable blade 34 returns to the first retracted position or second retracted position. The CPU 21 performs control such that the movable blade 34 stops at the first retracted position or second retracted position. The cutting device 1 can prevent the movable blade 34 from overrunning the first retracted position or second retracted position and can reliably halt the movable blade 34 in the first retracted position or second retracted position.

In the cutting device 1, the CPU 21 halts the first movable blade drive motor 27A or second movable blade drive motor 27B when detecting an overload on the first movable blade drive motor 27A or second movable blade drive motor 27B from the A/D converter 82A or A/D converter 82B. In this way, the CPU 21 can prevent the first movable blade 42 from contacting the tape 9 or fixed blade 41 and the second movable blade 52 from contacting the tape 9 or receiving part 51 with more than the prescribed drive force, thereby ensuring good durability of the first movable blade drive motor 27A, second movable blade drive motor 27B, and movable blade 34.

The printing device 100 is provided with the non-cutting mode for suspending the cutting operations of the cutting device 1. By setting the printing device 100 to the non-cutting mode, cutting operations with the cutting device 1 can be suspended, and the printing device 100 can continue to execute only printing operations on the tape 9 even though an abnormality has occurred in the cutting device 1.

in the embodiment described above, the tape 9 corresponds to the "target" of the present disclosure. The first movable blade 42 and second movable blade 52 correspond to the "cutting blade" of the present disclosure. The first movable blade drive motor 27A and second movable blade drive motor 27B correspond to the "drive portion" of the present disclosure. The flash memory 22 corresponds to the "memory" of the present disclosure. The CPU 21 corresponds to the "controller" of the present disclosure. The operating buttons 5 correspond to the "input interface" of the present disclosure. The first movable blade sensor 39A and second movable blade sensor 39B correspond to the "sensor" of the present disclosure. The thermal head 25 corresponds to the "printing portion" of the present disclosure.

Figure 12:
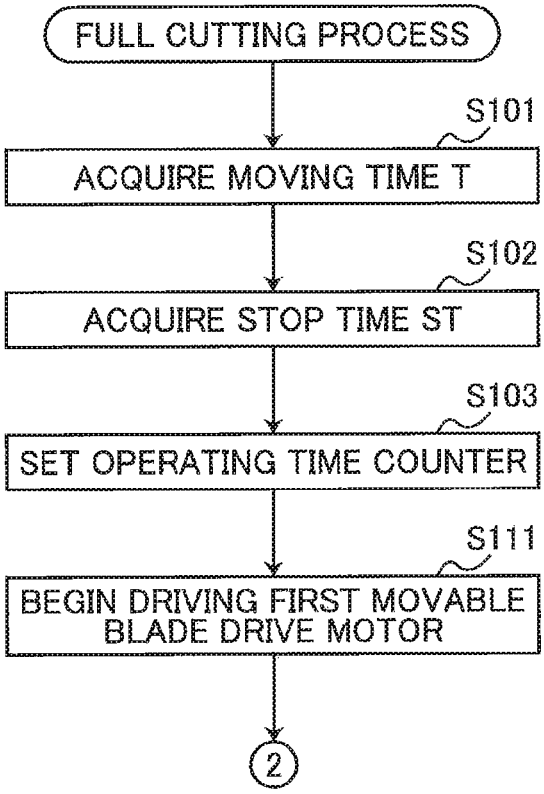
FIG. 12 is a flowchart illustrating part of steps in a full cutting process executed during the main process by the CPU of the printing device according to the embodiment.

The process of S52 and S62 in FIG. 12 corresponds to the "(a) controlling" and "(b) controlling" of the present disclosure. The process of S35 and S36 in FIGS. 10 and S204 in FIG. 14 corresponds to the "(c) controlling" of the present disclosure. The process of S215 in FIG. 14 corresponds to the "(d) updating" of the present disclosure. The position adjustment signal corresponds to the "command" received in the (e) receiving of the present disclosure. The process of S212 in FIG. 14 corresponds to the "(f) acquiring" of the present disclosure. The process of S103 in FIG. 12 corresponds to the "(g) measuring" of the present disclosure. The process of S121 in FIG. 13 corresponds to the "(h) detecting" of the present disclosure. The process of S133 in FIG. 13 corresponds to the "(i) halting" of the present disclosure.

While the description has been made in detail with reference to specific embodiment, it would be apparent to those skilled in the art that various changes and modifications may be made thereto. In the embodiment described above, the user operates the operating buttons 5 on the printing device 100 to input various signals, such as the non-cutting mode signal, the designated printing number, the position update mode signal, and the next print command signal. However, the user may instead input the signals described above from an external device through operations on the external device.

While the printing device 100 of the present embodiment is provided with the first movable blade sensor 39A to detect whether the first movable blade 42 is in the retracted position, provision of the first movable blade sensor 39A is not essential. When the first movable blade sensor 39A is not provided, the retracted position of the first movable blade 42 may be set to the maximum separation position (see FIG. 7A), for example, and the cutting operation may reciprocate the first movable blade 42 between the maximum separation position and the cut complete position. Additionally, steps S126 and S141 through 5143 of the full cutting process and steps S205 through 5207 and 5211 through 5214 of the first position updating process may be omitted. The above description also applies to the second movable blade 52.

In the first position updating process according to the embodiment described above, the user repeatedly inputs a position adjustment signal at least until the first movable blade sensor 39A detects the first movable blade 42 at the detection position (S202 through. S205). However, the first movable blade 42 may instead be moved to the detection position through one input operation. This method can simplify operations for the user by not requiring the user to repeatedly input position adjustment signals. When the detection position differs from the first retracted position, the distance between the separated position (i.e., the second retracted position) and the detection position must be calculated. Therefore, the CPU 21 preferably performs control to halt the first movable blade 42 in the detection position, and subsequently to move the first movable blade 42 the prescribed distance each tune a position adjustment signal is inputted.

In the embodiment described above, the first movable blade 42 is moved the prescribed distance each time a position adjustment signal is inputted. However, the CPU 21 may continuously move the first movable blade 42 when a position adjustment signal is inputted once and may halt the first movable blade 42 upon receiving a stop signal for halting the first movable blade 42. In this case, the CPU 21 calculates the distance that the first movable blade 42 was moved on the basis of the time that elapsed between reception of the position adjustment signal and reception of the stop signal.

In the embodiment described above, the CPU 21 performs overrun correction to begin decelerating the first movable blade drive motor 27A or second movable blade drive motor 27B before the movable blade 34 has arrived in the first retracted position or second retracted position, but control by the CPU 21 need not include overrun correction.

In the non-cutting mode process (FIG. 15) of the embodiment described above, the CPU 21 begins another printing operation each time a next print command is received (S407: YES) while the print count has not yet reached the designated printing number. However, the CPU 21 may execute repeated printing operations in response to one print start command until the print count reaches the designated printing number, without requiring reception of a next print command. This method simplifies user operations by not requiring the user to input next print commands.

While the first movable blade sensor 39A and second movable blade sensor 39B are limit switches in the embodiment described above, optical sensors may be used instead. Further, sensors are only provided for detecting when the movable blades 34 are in the retracted position in the embodiment described above. However, sensors may also be provided for detecting when the movable blades 34 are in the cut complete position, for example.

In the embodiment described above, the first retracted position is set to the position at which the first movable blade sensor 39A or second movable blade sensor 39B detects the corresponding movable blade 34. However, the first retracted position may be set to the position of the corresponding movable blade 34 when the first movable blade drive motor 27A or second movable blade drive motor 27B is driven a prescribed number of rotations from the position for detecting the movable blade 34.

The structure of the blade unit 31 is not limited to that described in the embodiment. For example, while the blade unit 31 has both the first cutting blade 40 and the second cutting blade 50 in the embodiment described above, the blade unit 31 need only have one of the first cutting blade 40 and second cutting blade 50. Further, the first cutting blade 40 may be provided with a receiving part in place of the fixed blade 41, for example, and may adopt a configuration for cutting the tape 9 with either a full cut or a partial cut using a single cutting blade, as described below. In this case, the receiving part has a first receiving part formed with a flat surface, and a second receiving part formed with a recess. The receiving part is configured such that the area opposing the first movable blade 42 is switehable between the first receiving part and second receiving part.

When the first receiving part opposes the first movable blade 42, the first movable blade 42 performs a full cut through the tape 9 as the blade edge 421 contacts the first receiving part with no gap formed therebetween. When the second receiving part opposes the first movable blade 42, the first movable blade 42 performs a partial cut through the tape 9 as the blade edge 421 contacts the second receiving part with a gap formed therebetween by the recess.

In the embodiment described above, the first movable blade 42 is rotatably supported relative to the fixed blade 41 by the rotating shaft 37. However, the first movable blade 42 may be supported by a rail or other guide member so as to be capable of moving linearly in directions toward and away from the fixed blade 41. Further, the fixed blade 41 and first movable blade 42 may be arranged such that the blade edges 411 and 421 extend parallel to each other and are in contact with each other. In this case, the first movable blade 42 is known as a slide cutter that cuts the tape 9 between the first movable blade 42 and fixed blade 41 by moving the blade edge 421 linearly between one end of the blade edge 411 and the other.

In the embodiment described above, the first movable blade drive motor 27A of the cutting device 1 moves the first movable blade 42, and the second movable blade drive motor 27B of the cutting device 1 moves the second movable blade 52. However, the single first movable blade drive motor 27A may be configured to move both the first movable blade 42 and second movable blade 52.

In the embodiment described above, the tape 9 is configured by affixing the adhesive tape 92 to the printing base material 91 after the printing base material 91 has been printed. However, the adhesive tape 92 may be omitted from the tape 9. In this case, the printing base material 91 corresponds to the "target" of the present disclosure. The printing base material 91 may have a strip-like base material, and an adhesive layer provided on the base material. In this case, a release paper that can be peeled off the adhesive layer may be applied to the adhesive layer. The printing device 100 may also employ thermal paper, tubes, or the like as the cutting medium (target to be cut) and the printing medium.

When the cover 3 is in the closed position in the embodiment described above, only the entry opening 12 and tape-insertion opening 13 are covered, while the discharge opening 11 remains exposed. However, the cover 3 may also cover the discharge opening 11 when in the closed position while one or both of the entry opening 12 and tape-insertion opening 13 may be uncovered. Alternatively, the cover 3 may be omitted from the printing device 100. In this case, the user can easily visualize when the movable blade 34 is in an abnormal position.

What is claimed is:

1. A cutting device comprising;

a cutting blade reciprocally movable within a movable range including a first retracted position away from a target to be cut and a cut complete position at which cutting of the target is to be completed;

a drive portion configured to move the cutting blade;

a memory configured to store cutting data indicating at least the first retracted position; and a controller configured to perform:

(a) controlling the drive portion to move the cutting blade from the first retracted position to the cut complete position according to the cutting data, thereby cutting the target;

(b) controlling the drive portion to move the cutting blade from the cut complete position after the (a) controlling is completed;

(c) controlling, in response to determining that the cutting blade has stopped at an intervening position during one of the (a) controlling and the (b) controlling, the drive portion to move the cutting blade from the intervening position to a second retracted position, the intervening position being in between a cut start position at which cutting of the target is started and the cut complete position, the second retracted position being positioned within the movable range and being away from the target; and (d) updating the cutting data stored in the memory so as to indicate the second retracted position in place of the first retracted position.

2. The cutting device according to claim 1, wherein the controller is configured to further perform:

(e) receiving a command instructing to move the cutting blade to the second retracted position, and wherein the (c) controlling is performed in response to receiving the command.

3. The cutting device according to claim 2, further comprising:

an input interface configured to receive a user operation, the command being received via the input interface.

4. The cutting device according to claim 3, wherein the cutting device is accommodated in a housing of a printing device, the housing being formed with a discharge opening through which the target is discharged, and wherein the input interface is provided near the discharge opening.

5. The cutting device according to claim 1, further comprising:

a sensor configured to detect the cutting blade being positioned in the first retracted position, wherein the (c) controlling is performed in a case where the sensor fails to detect the cutting blade being positioned in the first retracted position.

6. The cutting device according to claim 5, wherein the controller is configured to further perform:

(f) acquiring a shift amount between the intervening position and the second retracted position, and wherein the (c) controlling controls the drive portion to move the cutting blade by a distance corresponding to the shift amount from the intervening position.

7. The cutting device according to claim 5, wherein the controller is configured to further perform:

(g) measuring an operating time required for the (a) controlling and the (b) controlling, and wherein the (c) controlling is performed in a case where the operating time reaches a prescribed time without detecting the cutting blade being positioned in the first retracted position.

8. The cutting device according to claim 1, wherein the (b) controlling decelerates the cutting blade before the cutting blade reaches the first retracted position during movement from the cut complete position to the first retracted position and stops the cutting blade at the first retracted position.

9. The cutting device according to claim 1, wherein the controller is configured to further perform:

(h) detecting an overload on the drive portion during one of the (a) controlling and the (b) controlling; and (i) halting the one of the (a) controlling and the (b) controlling in response to detecting the overload.

10. A printing device comprising:

a printing portion configured to perform a print on a target; and a cutting device comprising:

a cutting blade reciprocally movable within a movable range including a first retracted position away from the target to be cut and a cut complete position at which cutting of the target is to be completed;

a drive portion configured to move the cutting blade;

a memory configured to store cutting data indicating at least the first retracted position; and a controller configured to perform:

(a) controlling the drive portion to move the cutting blade from the first retracted position to the cut complete position according to the cutting data, thereby cutting the target;

(b) controlling the drive portion to move the cutting blade from the cut complete position after the (a) controlling is completed;

(c) controlling, in response to determining that the cutting blade has stopped at an intervening position during one of the (a) controlling and the (b) controlling, the drive portion to move the cutting blade from the intervening position to a second retracted position, the intervening position being in between a cut start position at which cutting of the target is started and the cut complete position, the second retracted position being positioned within the movable range and being away from the target; and (d) updating the cutting data stored in the memory so as to indicate the second retracted position in place of the first retracted position.

11. The printing device according to claim 10, wherein the cutting device is operable in a non-cutting mode in which cutting of the target is suspended.

12. The printing device according to claim 10, wherein the controller is configured to further perform:

(e) receiving a command instructing to move the cutting blade to the second retracted position, and.

wherein the (c) controlling is performed in response to receiving the command.

13. The printing device according to claim 12, wherein the cutting device further comprises an input interface configured to receive a user operation, the command being received via the input interface.

14. The printing device according to claim 13, further comprising:

a housing formed with a discharge opening through Which the target is discharged, wherein the input interface is provided near the discharge opening.

15. The printing device according to claim 10, wherein the cutting device further comprises a sensor configured to detect the cutting blade being positioned in the first retracted position, and wherein the (c) controlling is performed, in a case where the sensor fails to detect the cutting blade being positioned in the first retracted position.

16. The printing device according to claim 15, wherein the controller is configured to further perform:

(f) acquiring a shift amount between the intervening position and. the second retracted position, and wherein the (c) controlling controls the drive portion to move the cutting blade by a distance corresponding to the shift amount from the intervening position.

17. The printing device according to claim 15, wherein the controller is configured to further perform:

(g) measuring an operating time required for the (a) controlling and the (b) controlling, and wherein the (c) controlling is performed in a case where the operating time reaches a prescribed time without detecting the cutting blade being positioned in the first retracted. position.

18. The printing device according to claim 10, wherein the (b) controlling decelerates the cutting blade before the cutting blade reaches the first retracted position during movement from the cut complete position to the first retracted position and stops the cutting blade at the first retracted position.

19. The printing device according to claim 10, wherein the controller is configured to further perform:

(h) detecting an overload on the drive portion during one of the (a) controlling and the (b) controlling; and (i) halting the one of the (a) controlling and the (b) controlling in response to detecting the overload.

* * * * *